US005995064A

United States Patent [19]

Yanagisawa et al.

[11] Patent Number: 5,995,064

[45] Date of Patent: Nov. 30, 1999

[54] ANTENNA HAVING A RETURNED PORTION FORMING A PORTION ARRANGED IN PARALLEL TO THE LONGITUDINAL ANTENNA DIRECTION

[75] Inventors: Wasuke Yanagisawa; Ryo Horie; Takao Kawahara, all of Tokyo-to; Tadashi Oshiyama, Gumma-Ken; Michio Arai; Takumi Yano, both of Tokyo-to; Atsushi Sato, Gunma-Ken, all of Japan

[73] Assignee: Kabushiki Kaisha Yokowa, also trading as Yokowo Co., Ltd., Tokyo, Japan

[21] Appl. No.: 08/755,733

[22] Filed: Nov. 25, 1996

[30] Foreign Application Priority Data

| | | | |
|---|---|---|---|
| Jun. 20, 1996 | [JP] | Japan | 8-160016 |
| Aug. 12, 1996 | [JP] | Japan | 8-212540 |
| Aug. 12, 1996 | [JP] | Japan | 8-212541 |
| Aug. 12, 1996 | [JP] | Japan | 8-212542 |

[51] Int. Cl.[6] ..... H01Q 1/36

[52] U.S. Cl. ..... 343/895; 343/702

[58] Field of Search ..... 343/702, 895, 343/715, 745, 749, 806, 900, 901

[56] References Cited

U.S. PATENT DOCUMENTS

| | | | |
|---|---|---|---|
| 2,647,211 | 7/1953 | Smeby | 343/841 |
| 4,121,218 | 10/1978 | Irwin et al. | 343/702 |
| 4,604,628 | 8/1986 | Cox | 343/818 |
| 5,204,687 | 4/1993 | Elliott et al. | 343/702 |
| 5,363,114 | 11/1994 | Shoemaker | 343/828 |
| 5,365,247 | 11/1994 | Van Der Veen et al. | 343/702 |
| 5,412,392 | 5/1995 | Tsunekawa | 343/702 |
| 5,469,177 | 11/1995 | Rush et al. | 343/702 |
| 5,479,178 | 12/1995 | Ha | 343/702 |

(List continued on next page.)

FOREIGN PATENT DOCUMENTS

| | | |
|---|---|---|
| 396 532 | 10/1993 | Austria . |
| 274 592 A1 | 7/1988 | European Pat. Off. . |
| 06 090 108 | 3/1994 | European Pat. Off. . |
| 0 634 806 A1 | 1/1995 | European Pat. Off. . |
| 51-35099 | 9/1976 | Japan . |

(List continued on next page.)

OTHER PUBLICATIONS

Abstract of Japanese patent application No. 8–84017/1996.
Abstract of Japanese patent application No. 04196907.
A copy of certified U.S. patent application No. 07/266423, filed Nov. 2, 1988 which corresponds to Japanese.

*Primary Examiner*—Don Wong
*Assistant Examiner*—Tan Ho
*Attorney, Agent, or Firm*—Dickstein, Shapiro, Morin & Oshinsky LLP

[57] ABSTRACT

The antenna element (1) of a long conductor is formed with at least one returned portion (1*a*) arranged substantially in parallel to a longitudinal direction of the antenna element. In practice, a physical length of the antenna element in the longitudinal direction is determined to such a length as to be substantially resonated in a first frequency band, and the at least one returned portion (1*a*) is formed in such a way as to be resonated in a second frequency band twice higher than the first frequency band on the basis of an electric coupling with the adjacent antenna element. Further, the antenna can be constructed in such a way that: an antenna element (1) of a long conductor is formed with at least one returned portion arranged substantially in parallel to a longitudinal direction of the antenna element in such a way that an electrical length thereof is substantially ¾ wavelength of a frequency band of transmitted and received signals; and at least half element (213) of an electrical length of substantially ¼ wavelength of the frequency band beginning from an end portion of the antenna element on a side opposite to a feeder portion (30) side is formed as an extended antenna piece extending substantially in non-parallel to the substantially parallel-formed antenna elements (211, 212).

31 Claims, 21 Drawing Sheets

U.S. PATENT DOCUMENTS

| | | | |
|---|---|---|---|
| 5,517,206 | 5/1996 | Boone et al. | 343/806 |
| 5,561,437 | 10/1996 | Phillips et al. | 343/702 |

FOREIGN PATENT DOCUMENTS

| | | |
|---|---|---|
| 4196907 | 7/1992 | Japan . |
| 5-243834 | 9/1993 | Japan . |
| 7-94930 | 9/1993 | Japan . |
| 5-347507 | 12/1993 | Japan . |
| 6-34309 | 5/1994 | Japan . |
| WO 95/08853 | 3/1995 | Japan . |
| 7-106994 | 4/1995 | Japan . |
| 7-70896 | 7/1995 | Japan . |
| 7-288412 | 10/1995 | Japan . |
| 7-321527 | 12/1995 | Japan . |
| 8-32332 | 2/1996 | Japan . |
| 8-84017 | 3/1996 | Japan . |
| 8-503835 | 4/1996 | Japan . |
| WO 94/10720 | 5/1994 | WIPO . |
| WO 97/49141 | 12/1997 | WIPO . |

ANTENNA HAVING A RETURNED PORTION FORMING A PORTION ARRANGED IN PARALLEL TO THE LONGITUDINAL ANTENNA DIRECTION

BACKGROUND OF THE INVENTION

1. Field of the Invention

The present invention relates to an antenna for transmitting and receiving radio signals which is suitable for use with a portable apparatus (e.g., portable telephone set) and a radio (AM and FM) and TV apparatus using the same antenna, and more specifically to a small-sized antenna for transmitting and receiving radio signals of two or more frequency bands and a radio apparatus using the same small-sized antenna.

2. Description of the Prior Art

Conventionally, as an antenna for a radio apparatus such as a portable telephone set, a rod-shaped antenna 32 as shown in FIG. 24 has been used. This antenna 31 can be inserted into a casing of the radio apparatus 31 when not used but can be extended from the casing when used. Further, this rod antenna 32 is formed in such a way that the length thereof matches about a ¼ wavelength or a ½ wavelength of radio signals to be transmitted and received. Therefore, when the transmitted and received frequency band is decided, the length of the rod antenna can be decided unequivocally. As a result, when low frequency signals are transmitted and received, the length of the antenna is inevitably lengthened. In order to shorten the external dimension of the rod antenna, various methods have been so far adopted such that an antenna wire (e.g., piano wire) is wound into a coil shape and the outer circumference thereof is covered with a resin, for instance.

On the other hand, in the antenna used for the portable apparatus, various methods have been so far adopted to prevent the long antenna from being obstructive when carried. For instance, when not used, the antenna is inserted into the portable apparatus in such a way that a part of the antenna is kept exposed from the casing to receive only a call signal or that another antenna for receiving only a call signal is attached to the casing and the entire antenna is extended to the outside from the casing to increase the sensitivity only during communications. Here, in the case where an antenna for receiving only a call signal and another antenna extended only during communications are both used, there are two types. One is a top coil type in which the call signal receiving antenna is loaded at the end of the communication antenna, and the other is a bottom coil type in which the call signal receiving antenna is always kept housed in the radio apparatus casing as it is even when the communication antenna is extended for use.

In summary, the call signal receiving antenna itself must be long enough to satisfy a length of about ¼ or ½ wavelength of the transmitted and received signals, and in addition must be short enough not to be obstructive when carried. Therefore, in general, the call signal receiving antenna is wound into a coil shape to shorten the external length of the antenna. Further, in the case of the communication antenna, when the frequency band of the transmitted and received signals is low, since the length thereof increases and thereby the handling is not convenient, the communication antenna is usually shortened by winding it into a coil shape.

As described above, in the case where the antenna wire is wound into a coil shape in order to shorten the external length of the antenna, when the coil intervals are large, although no problem arises with respect to the electrical relationship between the coiled antenna elements, the coil length cannot be shortened sufficiently. On the other hand, when the coil intervals are short (the coil is wound densely), although the coil length can be shortened, since the current components perpendicular to the longitudinal direction of the antenna increase, the radiation resistance of the antenna is reduced due to the relationship with respect to the polarized wave plane. In this case, there exists a problem in that the antenna performance deteriorates even if a matching circuit is attached to the antenna.

Further, when the length of the antenna is about ¼ wavelength of the transmitted and received signals, since this antenna can function as an antenna of about ¾ wavelength of another frequency band three times higher than the frequency band of this antenna, this antenna can function in the same way as with the case of an antenna of about ¼ wavelength. Therefore, it is possible to transmit and receive the frequency bands odd-times (e.g/., three times, five times, etc.) higher than the frequency band of this antenna by use of the same antenna. On the other hand, however, in the case where the frequency band is twice higher than the frequency band of this antenna, since the antenna length is about ½ wavelength thereof, this antenna cannot function as an antenna as far as a special matching circuit for ½ wavelength thereof is not attached thereto on the antenna feeding side. That is, it is impossible to transmit and receive signals of frequency bands of even-number (e.g., two times, four times, etc.) relationship with respect to the frequency band of this antenna or signals in the vicinity of these frequency bands by use of the same antenna. In practice, however, in the case of the portable telephone sets in Europe, for instance, since the frequency band of 900 MHz is used in GSM (group special mobile) (which corresponds to PDC (personal digital cellular) in Japanese system), and further the frequency band of 1800 MHz is used in DCS (digital cellular system) (which corresponds to PHS (personal handy-phone system) in Japanese system), it is particularly preferable to transmit and receive radio signals of a plurality of frequency bands by use of only a single antenna. Conventionally, however, in order to transmit and receive radio signals of both the frequency bands, it has been so far necessary to provide two different antennas or to use an antenna such that another antenna is connected to an end of a high frequency band antenna via a trap circuit in such a way that the total antenna length can match that of the low frequency band antenna.

SUMMARY OF THE INVENTION

With these problems in mind, therefore, it is the object of the present invention to provide an antenna which can realize a small-sized antenna required for a portable apparatus for transmitting and receiving radio signals, without deteriorating the antenna performance and without attaching any special matching circuit thereto.

Further, another object of the present invention is to provide an antenna which can transmit and receive radio signals of two or more frequency bands, for instance such that radio signals of the frequency bands even-number times (other than the odd-number times) higher than low frequency band can be transmitted and received by use of a single antenna together with radio signals of the low frequency band.

Further, still another object of the present invention is to provide an antenna which can achieve the above-mentioned objects in spite of the antenna suitable for use with a portable apparatus in such a way that a part of the antenna can be extended from the casing during communications but retracted into the casing during standby.

Further, still another object of the present invention is to provide a radio apparatus using a small-sized antenna which can transmit and receive radio signals of two or more frequency bands.

Further, still another object of the present invention is to provide an antenna which can realize a small-sized antenna required for the portable apparatus for transmitting and receiving radio signals, and which can receive a call signal by a first antenna portion whose external dimension is reduced and can receive communication signals at a high sensibility by a second antenna portion extended from the casing.

Further, another object of the present invention is to provide an antenna which can transmit and receive radio signals of the frequency bands even-number times (other than the odd-number times) higher than low frequency band together with radio signals of the low frequency band, for instance as with the case of radio signals of a low frequency band and a twice higher frequency band, by use of the same single antenna.

Further, still another object of the present invention is to provide an antenna which can shorten the total antenna length even when the second antenna is extended for communications and can facilitate the retraction and extension of the second antenna into and from the casing.

Further, still another object of the present invention is to provide an antenna which can facilitate the retraction and extension of the antenna into and from the casing, while fixing the antenna securely in both the retracted and extended states.

Further, still another object of the present invention is to provide an antenna, which is particularly suitable for use with a portable telephone set having a first antenna portion for receiving a call signal and a second antenna portion electrically coupled with the first antenna portion and extended during communications, and securely fixed to the casing during both the retraction and extension states of the antenna.

Further, the other object of the present invention is to provide a portable apparatus using an antenna not obstructive when carried.

To achieve the first object, the inventors have studied how to obtain such a small-sized antenna suitable for use with a portable radio apparatus (i.e., retractable when carried), which can receive a call signal when retracted and can transmit and receive radio signals of two or more frequency bands including high frequency bands even-number times higher than a low frequency band when extended, without providing any special matching circuit and without deteriorating the antenna performance. As a result of the study, the inventors have found the following facts: When the antenna element is returned six or less times so as to extend roughly in parallel to the antenna longitudinal direction, since the electrical length of the antenna element does not much change for a first frequency band (e.g., 900 MHz), the antenna can be used as about ¼ wavelength antenna of the first frequency band (as previously designed). However, since the electrical length of the antenna element much changes for a second frequency band (e.g., 1800 MHz) about twice higher than the first frequency band, the antenna can be used as about ¾ wavelength antenna of the second frequency band. In other words, it is possible to transmit and receive radio signals of two or more frequency bands (not the frequency bands odd-times higher than the first frequency band) by adjusting the number of turns and the intervals between the two adjacent antenna elements.

Therefore, the antenna of the present invention is characterized in that an antenna element formed by a long conductor is formed with at least one returned portion arranged substantially in parallel to a longitudinal direction of the antenna element.

Here, "substantially in parallel to" implies that the adjacent antenna elements can be located in such positional relationship as to be coupled capacitively and/or inductively, without implying "perfect parallel positional relationship". Further, "the longitudinal direction" implies a direction that electromagnetic waves propagate along the conductor.

The physical length of the antenna element in the longitudinal direction is determined to such a length as to be resonated substantially in a first frequency band, and the at least one returned portion is formed in such a way as to be resonated substantially in a second frequency band twice higher than the first frequency band on the basis of an electric coupling with the adjacent antenna element. Therefore, it is possible to transmit and receive signals of multi-frequency bands of even-number relationship (e.g., 900 MHz and 1800 MHz as with the case of the portable telephone sets) by use of a single antenna.

Here, "the length resonated substantially in the first frequency band" implies that signals of the first frequency band can be transmitted and received in a usual coupling rate without causing a large loss. In practice, "this length" implies such a length obtained by finely adjusting the lengths of about ¼ or ½ wavelength of the first frequency band under due consideration of the influences of the resistance components and the inductive components of a casing (to which the antenna is attached) and various metal fixtures upon the antenna in the method of try and error.

Here, when the long conductor is a belt-shaped body, the antenna can be formed simply by punching or by etching a thin film formed in accordance with deposition or evaporation. The belt-shaped body can be disposed on an outer circumference of a cylindrical bobbin or formed at an end of a printed circuit board on which a transmit and receive circuit is formed. In this case, a small-sized antenna can be obtained simply.

Further, when the antenna element formed with the returned portion is wound into a coil shape with the longitudinal direction of the antenna element as its central axis thereof by maintaining electrical coupling with the adjacent antenna element, it is possible to further shorten the antenna shortened by forming the returned portions.

Further, it is preferable that the long conductor is formed into a zigzag shape and formed with the returned portion in such a way that zigzag portions thereof are adjacent to each other, because the antenna can be further shortened.

Further, it is preferable that the length of the long conductor in the longitudinal direction is decided so as to correspond to substantially ¼ wavelength of the first frequency band, because the antenna can be further shortened and additionally the antenna can function as a multi-frequency band antenna which can transmit and receive signals of frequency bands even-times higher (e.g., twice) than the lowest frequency band in addition to the frequency bands odd-number times higher than the lowest frequency band.

Here, "substantially ¼ wavelength" implies that the antenna formed with the returned portions can resonated in about ¼ wavelength of a frequency band. In practice, however, the electrical length is reduced to less than ¼ wavelength of the frequency band. Even in this case, the antenna can be resonated in about ¼ wavelength of the frequency band due to the presence of the capacitance between the antenna elements.

Here, the other end of the first antenna portion and one end of the second antenna portion are electrically coupled capacitively and/or inductively, without direct contact between the two antenna portions. In this case, since no contact piece is required between both, this structure is stable from the mechanical standpoint.

Further, when the first antenna portion is the first antenna element formed with the returned portion as defined by the claim (1) and the first antenna element is formed by an electrically conductive belt-shaped body disposed on an outer circumference of a cylindrical bobbin formed of an electrically insulating substance, it is possible to obtain a small-sized antenna of multi-frequency bands, which is suitable for use with a portable radio apparatus.

Here, the practical structure for connecting the first and second antenna portions electrically is such that one (lower) end of the first antenna element is electrically connected to a metal fixture for mounting a feeder disposed at a lower portion of the first antenna portion; and the other (upper) end of the first antenna element is formed with a projection portion projecting radially inward of the bobbin via a through hole formed at a part of a side wall of the bobbin; and the first and second antenna portions are connected electrically by fitting the projection portion to a recessed portion formed in a metal stopper attached to a lower end of the second antenna portion in electrical contact with the second antenna element.

Here, the first antenna portion and the second antenna portion are connected to each other electrically or coupled to each other capacitively and/or inductively without direct contact between both or decouple from each other electrically.

Further, to achieve the second object, the antenna according to the present invention is characterized by a first antenna portion formed with the returned portions along the antenna axial direction to shorten the external dimensions thereof and transmitting and receiving signals of one frequency band and other frequency bands even-number (twice) times higher than the one frequency band; and a second antenna portion extended from the casing during communications to increase the sensitivity; means for coupling the first and second antenna portions without reducing the sensitivity of the antenna; or means for transmitting and receiving signals of two or more frequency bands of even-number relationship by use of the second antenna portion.

That is, the antenna according to the present invention comprises: a first antenna portion having an antenna element formed by a long conductor and formed with at least one returned portion arranged substantially in parallel to a longitudinal direction of the antenna element, the first antenna portion being formed in such a way that a total electrical length thereof is substantially ¼ wavelength of a first frequency band but substantially ¾ wavelength of a second frequency band; and a second antenna portion having one end portion connected electrically to the first antenna portion when extended externally from a casing, the second antenna portion being composed of a first antenna element formed in such a way that an electrical length thereof is substantially ½ wavelength of the second frequency band and a second antenna element connected to the first antenna element electrically and formed in such a way that a total electrical length together with the first antenna element is substantially ½ wavelength of the first frequency band.

Here, "substantially in parallel to" implies that the adjacent antenna elements can be located at such a positional relationship as to be coupled capacitively and/or inductively, without implying "perfect parallel". Further, "the longitudinal direction" implies a direction that electromagnetic waves propagate along the conductor.

Further, "the electrical length of substantially ¼ wavelength" implies such a length that the antenna formed with the returned portions can resonate in about ¼ wavelength of a frequency band, which is finely adjusted under due consideration of the influences of the resistance components and the inductive components of a casing (to which the antenna is attached) and various metal fixtures upon the antenna in the method of try and error. In practice, the electrical length of the antenna is determined less than ¼ wavelength of the frequency band. In this case, however, the antenna can be resonated in about ¼ wavelength of the frequency band due to the presence of the capacitance between the antenna elements. "substantially ¾ wavelength" and "substantially ½ wavelength" imply the same. Further, the electrical connection implies the direct contact between two conductors and the capacitive and/or inductive coupling between two conductors.

Further, the first antenna element and the second antenna element are connected to each other via a trap parallel-resonated in the second frequency band. Therefore, the second antenna element over the trap does not function electrically in the second frequency band but functions as ½ wavelength of the first frequency band together with the first antenna element. Further, since the trap does not function in the first frequency band, the antenna can transmit and receive signals of both the frequency bands at a high sensitivity.

Further, the first antenna element and the second antenna element are connected to each other via a phase shifter for shifting a phase of 180 degrees with respect to the second frequency band. Therefore, since both the antenna elements are in phase with each other; that is, since two ½ wavelength antenna elements are connected in series, it is possible to increase the antenna sensitivity markedly.

Further, the first antenna portion is formed with a coupling returned portion at a position an electrical length of substantially ¼ wavelength of the second frequency band away from one end portion thereof on feeder portion side, and further the second antenna portion is so disposed as to be coupled capacitively and/or inductively with both the coupling returned portion and the other end of the first antenna portion. In this case, the first and second antenna portions can be connected electrically at a high efficiency for both the first and second frequency bands.

In an embodiment of the antenna according to the present invention, a second antenna portion formed so as to have an electrical length of substantially ½ wavelength of one frequency band is connected electrically, when extended, to a first antenna portion formed in such a way a total length thereof has an electrical length of substantially ¾ wavelength of the one frequency band; and the first antenna portion is formed in such a way that a portion corresponding to an electrical length of substantially ¾ wavelength of the frequency band can function as a phase shifter for canceling electric fields with each other. In this embodiment, even if the first and second antenna portions are directly connected to each other electrically, since the electrical length portion of ¾ wavelength of the frequency band functions as a phase shifter, the electrical length portion of about ¼ wavelength of the first antenna portion is in phase with the electrical length portion of about ½ wavelength of the second antenna portion, so that a high sensitive antenna can be obtained.

Further, in another embodiment of the antenna according to the present invention, the antenna comprises: a first antenna portion having an antenna element formed by a long conductor and formed with at least one returned portion arranged substantially in parallel to a longitudinal direction of the antenna element; and a second antenna portion having one end portion connected electrically to the first antenna portion when extended externally from a casing, the second antenna portion being a series resonance circuit having an inductor element and a capacitor element and coupled with the first antenna portion capacitively and/or inductively. In this case, the size of the second antenna portion can be reduced markedly, so that the second antenna portion can be extended and retracted easily by use of a button.

Further, it is also preferable that the first antenna portion is formed with the returned portion for transmitting and receiving both first and second frequency bands, respectively; the second antenna portion is composed of a first series resonance circuit series-resonated in the first frequency band and a second series resonance circuit series-resonated in the second frequency band; and the first and second series resonance circuits are coupled with each other capacitively and/or inductively. In this case, it is possible to transmit and receive signals of two or more frequency bands by use of a short antenna.

To achieve the third object, the antenna formed with the returned portions is further improved. That is, when the antenna is formed with the returned portions so as to transmit and receive signals of the two frequency bands of even-number relationship, since the antenna functions as an antenna resonated in about ¾ wavelength of the twice-higher frequency band, the current distributions become the same in magnitude but opposite in direction at the electrical length portion of ⅔ wavelength of the frequency band, so that the current distributions are canceled with each other, thus causing a reduction of the antenna sensitivity. Further, when the second antenna portion extended from the casing during communications is connected to the first antenna portion, the electrical length of the first antenna portion is about ¾ wavelength of the second frequency band twice higher than the first frequency band. Therefore, when the second antenna portion is formed so as to have an electrical length of about ½ wavelength of the frequency band, since the second antenna portion is out of phase with the first antenna portion at the electrical length portion of about ⅔ wavelength of the frequency band, the sensitivity thereof is reduced.

To overcome this problem, the antenna according to the present invention is formed with: an antenna element formed by a long conductor and formed with at least one returned portion arranged substantially in parallel to a longitudinal direction of the antenna element in such a way that an electrical length thereof is substantially ¾ wavelength of a frequency band of transmitted and received signals; and at least half of an electrical length of substantially ¼ wavelength of the frequency band beginning from an end portion of the antenna element on a side opposite to a feeder portion side is formed as an extended antenna piece extending substantially in non-parallel to the substantially parallel-formed antenna element. As a result, it is possible to eliminate the antenna element portion at which the current distributions are the same in magnitude and opposite in direction, so that the current distributions are not canceled with each other.

Further, it is preferable that at least half of the electrical length of substantially ¼ wavelength portion extending substantially in non-parallel is extended in such a way that small crank-shaped portions are repeatedly formed along the substantially parallel-formed antenna element. In this case, since the current components are canceled with each other by the small crank-shaped portions and thereby a part of the portion of ⅔ wavelength of the antenna element can be eliminated without canceling the other ¼ wavelength portion, the sensitivity can be further improved. Further, in this structure, since the crank-shaped portions can be extended in the direction substantially the same as with the case of the parallel-arranged antenna elements, the antenna space can be reduced and further the connection with the second antenna portion can be facilitated.

Further, in an embodiment of the antenna according to the present invention comprises: an antenna element formed by a long conductor and formed with at least one returned portion arranged substantially in parallel to a longitudinal direction of the antenna element in such a way that an electrical length thereof is substantially ¼ wavelength of a first frequency band; and a coupling returned portion formed so as to be coupled with a second antenna portion capacitively and/or inductively at a position an electrical length of substantially ¼ wavelength of a second frequency band away from a feeder portion side of the antenna element. As a result, when connected to the second antenna, the first antenna portion is coupled at the coupling returned portion in the second frequency band, since the electrical length portion of ⅔ wavelength of the first antenna portion can be omitted, it is possible to prevent the sensitivity from being reduced due to the cancellation of the electrical length portion of ⅔ wavelength of the first antenna portion with the electrical length portion of ½ wavelength of the second antenna portion.

Further, in an embodiment of the antenna according to the present invention, the antenna comprises: a first antenna portion as defined by claim (25) and formed by an antenna element disposed on an outer circumferential portion of a cylindrical insulating body; a second antenna portion coupled with the first antenna portion capacitively and/or inductively when extended externally being slidably moved along an inner circumferential portion of the insulating body; and the end portion of the antenna element of the first antenna portion being formed at a position farther away from the second antenna portion than the coupling returned portion in such a way that the second antenna portion can be easily coupled with the coupling returned portion of the first antenna portion in the second frequency band at an end portion opposite to a feeder portion of the antenna element of the first antenna portion. Therefore, since the coupling between the first and second antenna portions can be further increased at the coupling returned portion of the first antenna portion in the second frequency band, and facilitated at the end portion of the first antenna portion by the ¼ waveform resonance in the first frequency band.

Further, in an embodiment of the antenna according to the present invention, the antenna, comprises: a cylindrical core fixed to a metal fixture at one end thereof; a ring spring disposed coaxially with the core on the other end portion of the core; a cap formed with a through hole communicating with a central hole of the core and covering the core and the ring spring; and a rod antenna member formed with a large-diameter top portion and a joint portion on both ends thereof so as to be slidably fitted to the central hole of the core, and wherein a notch engaged with the ring spring is formed at the top portion and the joint portion of the rod antenna member, respectively. As a result, the core formed with no slit can be always in slidable contact with the large diameter portion of the rot antenna member with a constant inner diameter, and the ring spring is engaged with the notches formed in the large diameter portion of the rod antenna member when the antenna member is extended and retracted. Here, since the ring spring is an independent spring member held by the core and the cap, the rod antenna element can be fixed by a sufficiently large elastic force of the ring spring.

Further, it is preferable that a split-type stopper having an outer diameter larger an inner diameter of a hole of the cylindrical core, through which the joint portion of the rod antenna member is slidably moved, is fitted to an end portion of the joint portion of the rod antenna member. In this structure, since the stopper can be attached to the rod antenna member after the rod antenna member has been inserted into the cap, ring spring and the core, it is possible to prevent from forming a slit in the core for passing the stopper or from increasing the inner diameter of the core, so that a reliable click structure of the rod antenna member can be obtained.

Further, it is preferable that the cylindrical core is formed of an electrically insulating substance, and a first antenna portion is formed by disposing an antenna element on an outer circumference of the core. As a result, it is possible to obtain an antenna suitable for use with a portable telephone set such that the first antenna portion for receiving only a call signal and the second antenna portion extended during communications are both used, by a lesser number of parts, in a simple structure, and with a reliable click structure when the rod antenna member is extended and retracted.

Further, the present invention provides a radio apparatus comprising: a high frequency circuit board disposed in a casing; and an antenna formed with an antenna element formed by a long conductor and formed with at least one returned portion arranged substantially in parallel to a longitudinal direction of the antenna element, the antenna being provided on the high frequency circuit board.

Further, the present invention provides a radio apparatus comprising: a high frequency circuit board disposed in a casing; and an antenna element formed by a long conductor and formed with at least one returned portion arranged substantially in parallel to a longitudinal direction of the antenna element in such a way that an electrical length thereof is substantially ¾ wavelength of a frequency band of transmitted and received signals; and at least half of an electrical length of substantially ¼ wavelength of the frequency band beginning from an end portion of the antenna element on a side opposite to a feeder portion side is formed as an extended antenna piece extending substantially in non-parallel to the substantially parallel-formed antenna element, the antenna being provided on the high frequency circuit board.

BRIEF DESCRIPTION OF THE DRAWINGS

FIGS. 3*a* and 3*b* are partly cross-sectional views showing a practical embodiment of the antenna shown in FIG. 1, in which FIG. 3*a* shows a first antenna portion shown in FIG. 1 is connected to a second antenna portion extended from a casing for communications, and FIG. 3*b* shows the first antenna portion shown in FIG. 1 is disconnected from the second antenna portion retracted into the casing for standby to receive a call signal;

FIG. 4*a* is a perspective view showing a bobbin shown in FIG. 3*a; * and FIG. 4*b* is a perspective view showing the first antenna portion shown in FIG. 3*a.

FIGS. 6*a,* 6*b* and 6*c* are illustrations showing another modification (top coil type) of the antenna shown in FIG. 1, in which FIG. 6*a* shows the case where the first and second antenna portions are connected directly.

FIGS. 7*a* and 7*b* are illustrations showing a second embodiment of the antenna according to the present invention such that the second antenna portion is composed of first and second antenna elements and coupled to each other via an impedance element, in which FIG. 7*a* shows a conceptional structure and the electrical length relationship between the first and second antenna portions; and FIG. 7*b* is a diagram showing a current distribution obtained when a total electrical length of both the first and second antenna elements of the second antenna portion is one ($\lambda_H$) wavelength of the second (high) frequency band, so that the current distribution is out of phase with respect to each other in total and thereby canceled with each other in the second frequency band;

FIGS. 10*a* and 10*b* are illustrations showing various coupling methods between the first and second antenna portions, in which FIG. 10*a* shows the case where the first and second antenna portions are coupled with each other capacitively and inductively and FIG. 10*b* shows the case where the first and second antenna portions are directly connected to each other;

FIGS. 11*a,* 11*b,* 11*c* and 11*d* are illustrations showing various modifications of the first and second embodiments of the antenna according to the present invention to further reduce the size of the second antenna portion, in which FIG. 11*a* shows the case where the second antenna portion is formed by a series resonance circuit.

FIGS. 12*a,* 12*b* and 12*c* are illustrations for assistance in explaining a problem caused when the total length of the antenna element of the antenna of the first embodiment shown in FIG. 1 becomes the electrical length of about ¾ wavelength of a frequency band, in which FIG. 12*a* shows the cancellation of the current distributions when the antenna is folded in three.

FIGS. 13*a,* 13*b* and 13*c* are illustrations showing a third embodiment of the antenna according to the present invention, in which FIG. 13*a* shows an antenna having the third antenna element piece extending in a direction perpendicular to the other antenna element pieces; FIG. 13*b* shows a gain pattern obtained by the antenna shown in FIG. 13*a.

FIGS. 14*a* and 14*b* are illustrations showing two modifications of the antenna shown in FIG. 13*a,* in which FIG. 14*a* shows an antenna having the third antenna element piece of crank-shape extending in parallel to the other antenna element pieces; and FIG. 14*b* shows an antenna having the third antenna element piece returned at a position far away from the second antenna element piece;

FIGS. 16*a* and 16*b* are partly cross-sectional views showing another practical embodiment of the coupling method between the first and second antenna portions, in which FIG. 16*a* shows the two antenna portions when the second antenna is extended from the casing; and FIG. 16*b* shows the two antenna portions when the second antenna is retracted into the casing;

FIGS. 17*a,* 17*b,* 17*c* and 17*d* are partly cross-sectional views and plane and perspective views, respectively showing a fourth embodiment of the antenna according to the present invention, in which FIGS. 17*a* and 17*b* show the two antenna portions when the second antenna portion is extended from the casing.

FIGS. 21*a* and 21*b* are cross-sectional views showing a modification of the antenna shown in FIG. 19, in which FIG. 21*a* shows the rod antenna element retracted into the casing and FIG. 21*a* shows the same rod antenna element extended from the casing;

DETAILED DESCRIPTION OF THE PREFERRED EMBODIMENTS

The antenna according to the present invention will be described hereinbelow with reference to the attached drawings.

FIRST EMBODIMENT

Figure 1:
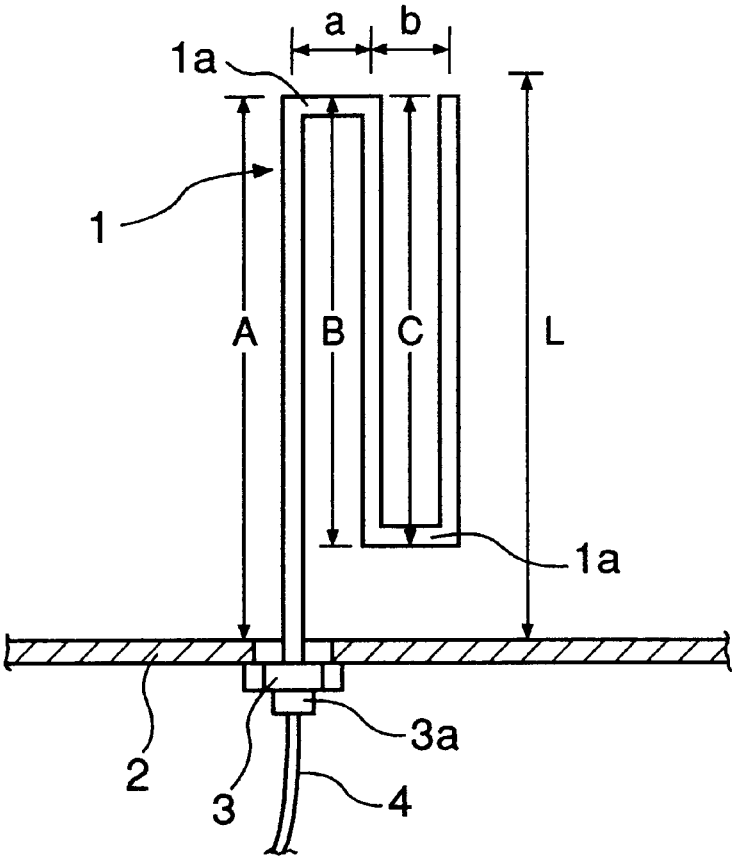
FIG. 1 is an illustration showing a first (basic) embodiment of the antenna having returned portions according to the present invention.

A first embodiment (i.e., a basic structure) of the antenna according to the present invention will be described hereinbelow with reference to FIG. 1. In FIG. 1, an antenna element 1 is formed by a copper wire, a piano wire, a belt-shaped conductive plate or a long conductor (e.g., a thin film). One end of the antenna element 1 is connected to a feeder portion 3*a* of a connector 3 via a casing 2 of a portable apparatus, and the feeder portion 3*a* is connected to a transmit and/or receive circuit (not shown) through a code 4. As shown in FIG. 1, the antenna of the present invention is characterized in that the antenna element 1 is returned at two return portions 1*a* so as to extend substantially in parallel to each other along the longitudinal direction thereof.

As already explained, the inventors have found that when the antenna element is returned so as to be substantially parallel to each other along the longitudinal direction thereof, the antenna element can be resonated at frequency bands even-number times (other hand the odd-number times) higher than a low frequency band. In more detail, when the antenna element 1 formed so as to have a length of about ¼ wavelength of a frequency band f1 is formed with the return portions 1*a* as shown in FIG. 1, the electrical length does not much change for the frequency band f1 and for the frequency bands odd-number times higher than the frequency f1 due to the capacitive coupling between the two adjacent antenna element pieces and the relationship between the even propagation mode and odd propagation mode of the antenna element 1; however, the electrical length can be much adjusted for the frequency bands even-number (e.g., two) times higher than the frequency f1 and the frequency bands in the vicinity of the higher frequency bands, by adjusting the number of returns and the intervals between the two returned antenna element pieces.

With reference to FIG. 1, the basic construction of the antenna according to the present invention will be explained in further detail hereinbelow. The antenna element 1 is formed in such a way that the total length (A+B+C) (a and b are very short and thereby negligible) obtained by extending the antenna in the longitudinal direction becomes about (the same meaning as "substantially") ¼ wavelength of the first frequency band f1 (the lowest frequency band of the signals to be transmitted and received). In an example shown in FIG. 1, two return portions 1*a* are formed in the antenna element 1 and thereby folded in three. The respective longitudinal lengths A, B and C of the element pieces of the antenna element folded in three are roughly equal to each other, and the intervals a and b between the two adjacent element pieces are so adjusted as to be resonated at a frequency band f2 (=2f1) twice higher than the frequency band f1. Although the intervals a and b are roughly the same in both, since this intervals are small as compared with the longitudinal length A, B and C, these lengths are short enough to be disregarded.

That is, the electrical length of the antenna element 1 can be set to a length of about ¾ wavelength of the frequency band f2 (=2f1) by adjusting the intervals a and b and the number of returns, without much changing the electrical length for the frequency band f1. This may be due to the fact that the matching condition with the ¼ wavelength of the frequency f1 (e.g., 900 MHz) and a frequency band odd-number times higher than f1 can be maintained without being subjected to the influence of the returned portions of the antenna element; however, the electrical length of the frequency band even number times higher than f1 or the frequency band in the vicinity of the higher frequency bands can be changed on the basis of the capacity between the two adjacent antenna element pieces and the current direction relationship between the even mode and the odd mode. As a result, this antenna can transmit and receive the signals of the frequency bands both odd-number and even-number times higher than f1. Further, it is also possible to resonate the antenna at an intermediate frequency band other than the frequency even-number times higher than f1 by adjusting the intervals between the antenna element pieces and the number of returns.

As described above, since the antenna element is folded in three, when the antenna element is molded by a protective casing formed of a resin, the total external length L of the antenna can be reduced down to about ¼ or ⅓ wavelength of f1, with the result that the total length thereof can be reduced as short as about 3 cm in the case of 900 MHz frequency band. When the number of returns is further increased, it is possible to further reduce the total length of the antenna.

However, it is not preferable to increase the number of return portions 1*a* excessively, because the capacity between the two adjacent element pieces increases. Therefore, the preferable number of returns is less than ten, and more preferably 2 to 6 returns. Further, in particular, it is preferable that the number of the element pieces is an odd number; that is, the number of the returned portions 1*a* is an even number, because the polarized wave plane can be uniformalized. Further, it is preferable that the intervals a and b between the two adjacent antenna element pieces is 1 to 5 mm when f1 is 900 MHz band.

Further, the antenna element 1 can be formed by a wire (e.g., copper wire, piano wire, etc.) or by a belt-shaped member (thin and broad) as shown in FIG. 1. Here, the belt-shaped member can be formed by punching a metal plate or by etching a thin film formed in accordance with vapor deposition. Further, the belt-shaped member can be simply formed simply at an end of a printed circuit board. Further, the antenna element pieces can be fixed by molding the entire antenna element after having been adjusted. Here, even if the total physical length of the antenna element 1 (i.e., A+B+C) is substantially ½ wavelength of the frequency band f1 (not substantially ¼ wavelength of f1), the antenna thus constructed can be resonated at a frequency band f1. Further, when a matching circuit is attached to the feeder portion, it is possible to transmit and receive radio signals by use of the antenna. In this case, the electrical length thereof is adjusted at the return portions 1*a* so as to be one or 3/2 wavelength of a frequency band f2 twice higher than f1.

Further, the antenna element 1 can be returned along the same direction on the same plane as shown in FIG. 1. Without being limited thereto, the antenna element 1 can be returned in such a way that the third element piece (whose length is C in FIG. 1) is turned so as to be located on the front side of the paper in close vicinity and in parallel to the other element pieces in three dimensions. In summary, the essential point is that the direction in which the antenna element 1 is returned substantially in parallel to the longitudinal direction of the antenna element 1.

As described above, since the antenna of the present invention is returned along the longitudinal direction thereof, as far as the longitudinal direction of the antenna element is kept constant in the polarized wave plane of electromagnetic waves and further the electrical length thereof is so adjusted as to become the odd-number times of about ¼ wavelength of the electromagnetic waves, it is possible to shorten the total external length L thereof, without reducing the antenna performance, even if any matching circuit is not attached thereto.

Figures 2A, 2B, 2C:
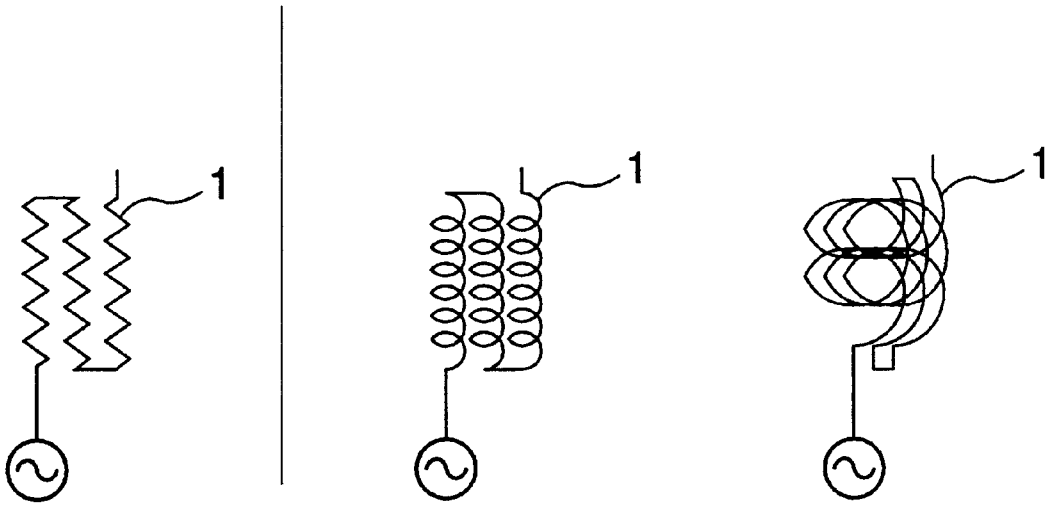
FIGS. 2*a,* 2*b* and 2*c* are illustrations showing three modifications of the first embodiment of the antenna shown in FIG. 1.

Here, in order to further shorten the total external length of the antenna element 1, the antenna can be formed into a zigzag or coil shape, as shown in FIGS. 2*a,* 2*b* and 2*c,* respectively to such an extent that the antenna performance does not deteriorate. In more detail, in the case shown in FIG. 2*a,* the antenna element 1 is formed by returning the element pieces each formed into a zigzag pattern in the longitudinal direction of the antenna; and in the case shown in FIG. 2*b,* the antenna element 1 is formed by returning the element pieces each formed into a coiled pattern in the longitudinal direction of the antenna. Further, in the case shown in FIG. 2*c,* the antenna element 1 is formed by winding each of the antenna element formed with the return portions as shown in FIG. 1 into a coil shape coarsely or loosely. In any of these examples, the total external antenna length can be shortened by forming a zigzag or coiled shape to such an extent as not to exert a harmful influence upon the antenna radiation characteristics.

Figure 3A:
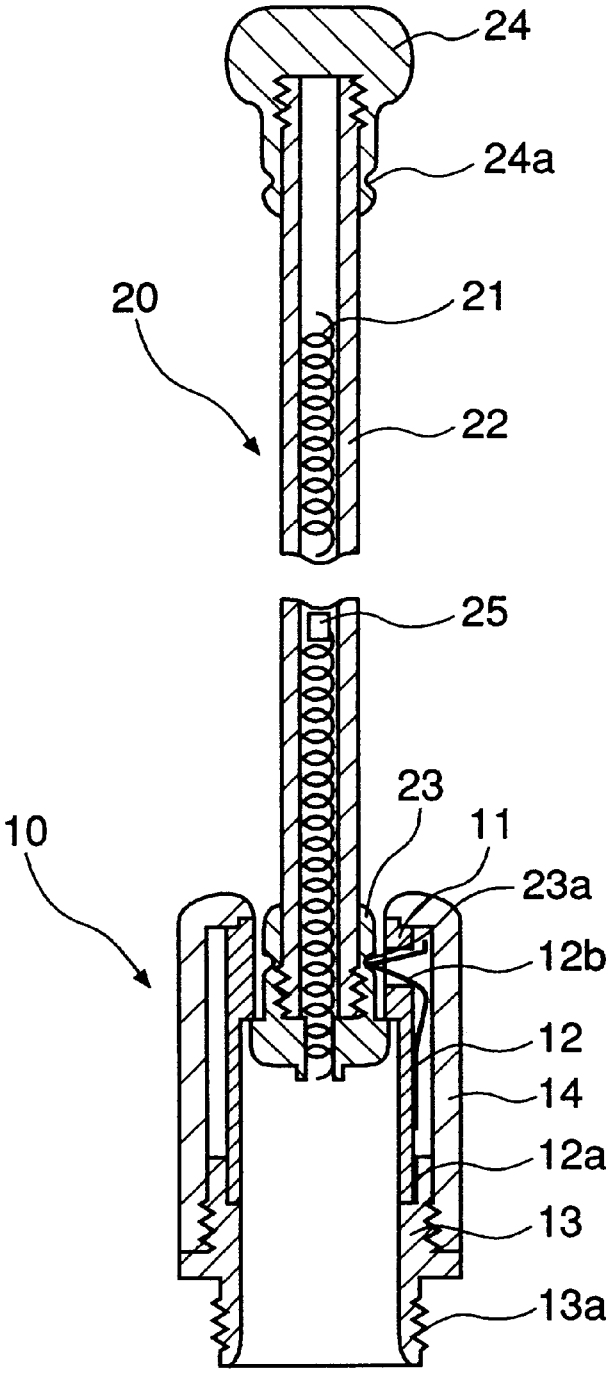
Figure 3B:
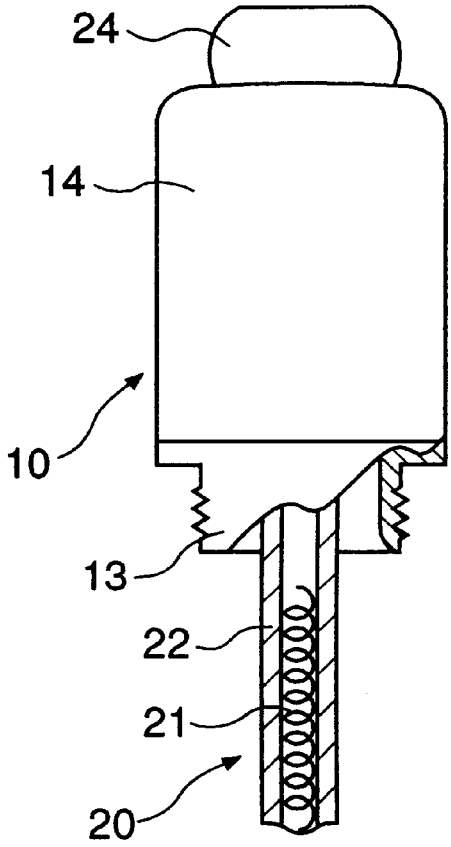
Figure 4A:
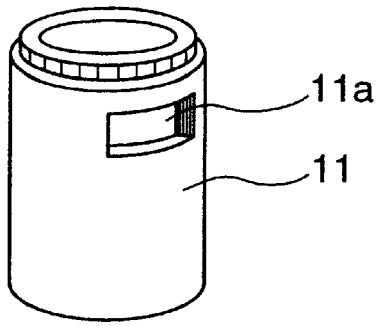

With reference to FIGS. 3*a* and 3*b* and FIGS. 4*a,* 4*b* and 4*c,* the antenna of the present invention will be described in detail hereinbelow in the form of a practical antenna suitable for use with a portable apparatus (e.g., a portable telephone set).

FIGS. 3*a* and 3*b* are cross-sectional view showing the practical antenna used for a portable telephone set, in which FIG. 3*a* shows the status where the antenna is extended for communications and FIG. 3*b* shows the status where the antenna is retracted for standby. In FIGS. 3*a* and 3*b,* a first antenna portion 10 is always kept exposed externally from a casing of the portable apparatus to receive a call signal, and a second antenna portion 20 is extended from the casing of the portable apparatus to increase the sensitivity only during communications.

Figure 4B:
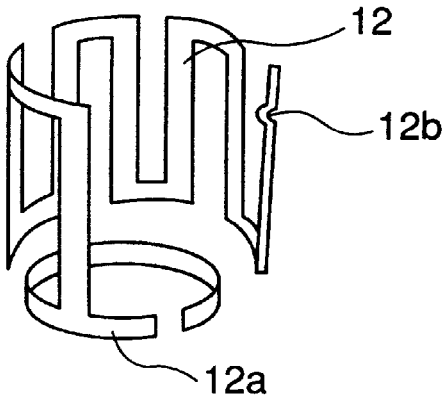
Figure 4C:
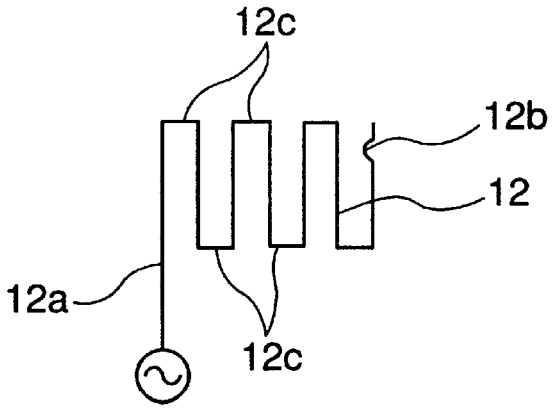
* and FIG. 4*c* is a development view showing the same first antenna portion shown in FIG. 4*b;*

The first antenna portion 10 is composed of a cylindrical bobbin 11 (as shown in FIG. 4*a*) formed of PE (polyethylene) or POM (polyoxymethylene), and a first antenna element 12 (as shown in FIG. 4*b*) pressure fitted to the outer circumference of the cylindrical bobbin 11 by an elastic force of the material of the first antenna element 12. The first antenna element 12 is formed into a cylindrical shape by punching a plate spring formed of phosphor bronze or beryllium copper with the use of a press machine in such a way that the total length thereof in the longitudinal direction is substantially ¼ wavelength of 900 MHz frequency band, for instance. Further, one (lower) end 12*a* of the first antenna element 12 is formed into a ring shape as shown in FIG. 4*b*. This end 12*a* of the first antenna element 12 is pressure fitted into an inner circumference of a mounting fixture 13 together with the bobbin 11 in such a way as to be connected to the mounting fixture 13 electrically, as shown in FIG. 3*a*. The other (upper) end of the first antenna element 12 is formed with an projecting portion 12*b* as shown in FIG. 4*b*, this protecting portion 12*b* is engaged with a recessed portion formed on an (lower) end of the second antenna portion 20 as a locking spring in such a way as to be fixed and connected to the second antenna portion 20 electrically. When developed as shown in FIG. 4*c*, the first antenna element 12 is formed with seven element pieces and six returned portions 12*c*. However, the first antenna element 12 can be formed with three element pieces and two returned portions as shown in FIG. 1. Further, the mounting fixture 13 of the first antenna portion 10 is formed with a threaded portion 13*a* as shown in FIG. 3*a* engaged with a threaded portion (not shown) formed in the casing of the portable telephone set. Further, in FIG. 3*a*, a cover 14 formed of ABS (acrylic butadiene styrene), elastomer, etc. is screwed with an upper threaded portion of the mounting fixture 13 to protect the first antenna element 12.

The second antenna portion 20 is used during communications after having been extended to the outside from the casing, which is formed by winding a piano wire or copper wire having substantially ½ wavelength of 900 MHz band into a coil shape. Further, the second antenna portion 20 is protected at the outer circumference thereof by a tube 22 formed POM, elastomer, etc. in such a way as to be movable in the bobbin 11 of the first antenna portion 10. The second antenna element 21 is formed with a trap 25 at an intermediate portion thereof in such a way that the continuous total length thereof functions in 900 MHz band and a lower half below the trap 25 functions in 1800 MHz band. Further, a stopper 23 formed of brass or PBS (phosphor bronze) is electrically connected to the lower end of the second antenna element 21 at the lower end of the second antenna portion 20 by a thread engagement with the tube 22 of the second antenna portion 20. Further, a top 24 formed of ABS, elastomer, etc. is screwed with the upper end of the second antenna portion 20 as a knob used when the second antenna portion 20 is pulled outside from the casing. This top 24 can be formed integral with the tube 22 of the second antenna portion 20 if desired.

Further, the stopper 23 is formed with a recessed portion 23*a* in the outer circumference thereof in such a way as to be engaged with the projecting portion 12*b* of the first antenna element 12 for electric contact therewith, when the second antenna portion 20 is pulled out of the casing. Therefore, when the second antenna portion 20 is extended, the first antenna element 12 is connected to the second antenna element 21 via the metal stopper 23, and thereby can function as an antenna having substantially ¾ wavelength of the 900 MHz band signals, so that the antenna can be resonated at 900 MHz band signals to transmit and receive the signals. Further, since the first antenna portion 10 has an electrical length of substantially ¾ wavelength of the 1800 MHz band signals, and further since the lower half of the second antenna portion 20 below the trap 25 has an electrical length of substantially ½ wavelength thereof, the antenna can be resonated at 1800 HMz band signal to transmit and receive the signals in the same way.

Further, the top 24 of the second antenna portion 20 is formed with a recessed portion 24*a* in the outer circumference of the lower portion thereof. Therefore, when the second antenna portion 20 is retracted and thereby housed in the casing, since the top 24 is inserted into the upper portion of the bobbin 11, the recessed portion 24*a* of the top 24 is engaged with the projecting portion 12*b* of the first antenna element 12, so that the top 24 can be securely fixed to the bobbin 11. Here, since the top 24 is formed of a resin and therefore insulated electrically, the second antenna portion 20 housed in the casing is perfectly isolated electrically, and thereby does not function as an antenna. As a result, only the first antenna portion 10 can function as an antenna for receiving a call signal. Further, in a region where the radio waves are sufficiently strong, the first antenna portion 10 can of course receive radio signals not only for a call signal but also for communications.

Figure 5A:
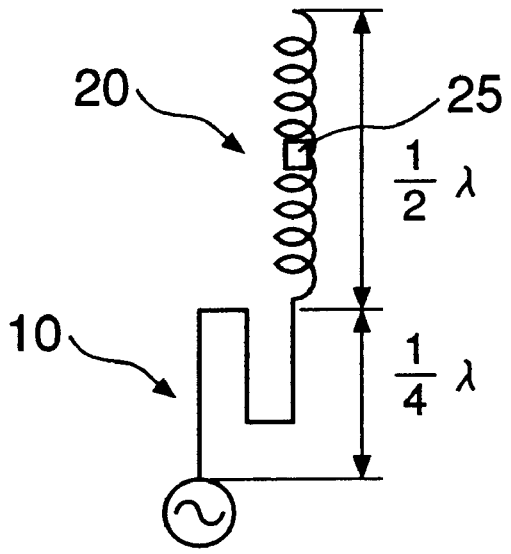
FIG. 5*a* is an illustration showing the electrical length relationship between the first and second antenna portions, obtained when the second antenna portion is extended in 900 MHz band.
Figure 5B:
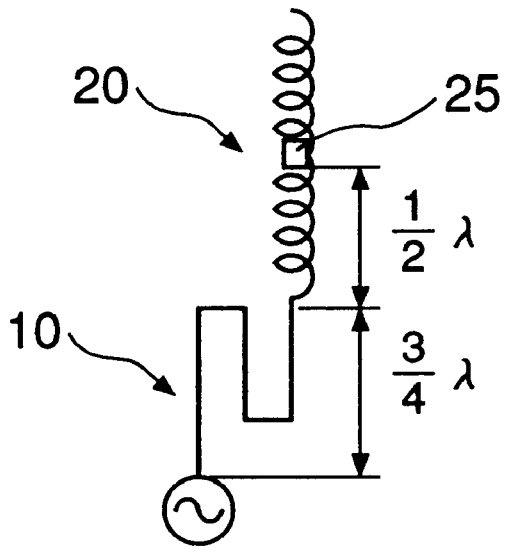
FIG. 5*b* is an illustration showing the electrical length relationship between the first and second antenna portions, obtained when the second antenna portion is extended in 1800 MHz band.
Figure 5C:
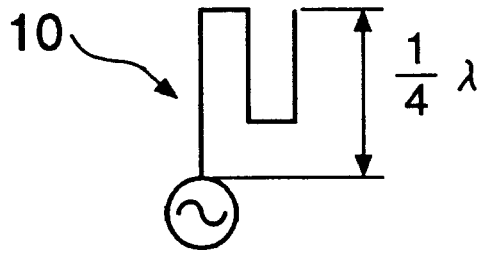
FIG. 5*c* is an illustration showing the electrical length relationship between the first and second antenna portions, obtained when the second antenna portion is retracted in 900 MHz band.
Figure 5D:
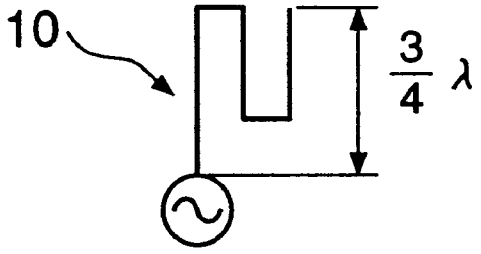
FIG. 5*d* is an illustration showing the electrical length relationship between the first and second antenna portions, obtained when the second antenna portion is retracted in 1800 MHz band.

FIGS. 5*a* and 5*b* show the electrical lengths for 900 MHz and 1800 MHz, respectively obtained when the second antenna portion 20 is extended for communications; and FIGS. 5*c* and 5*d* show the electrical lengths for 900 MHz and 1800 MHz, respectively obtained when the second antenna portion 20 is retracted and only the first antenna portion 10 is used for standby, in which the electrical length is denoted on the basis of the wavelength of λ. In the case of 900 MHz, the electrical length of the first antenna portion 10 is λ/4 thereof; and the electrical length of the second antenna portion 20 is λ/2 thereof. On the other hand, in the case of 1800 MHz, the electrical length of the first antenna portion 10 is 3λ/4; and the electrical length of the second antenna portion 20 is divided to λ/2 by a trap 25 provided midway of the second antenna portion 20. Therefore, the second antenna portion 20 can function as an antenna having about λ/2 wavelength in the 1800 MHz band.

In the example shown in FIG. 3*a*, the first and second antenna portions 10 and 20 are connected to each other directly or electrically. Without being limited only thereto, it is possible to connect both the first and second antenna portions 10 and 20 electrically on the basis of capacitive or inductive coupling by arranging both the antenna portions in close vicinity with respect to each other, without direct contact between both. In this case, the stopper 23 is formed of an electrically insulating material, without use of a metal.

Figure 6A:
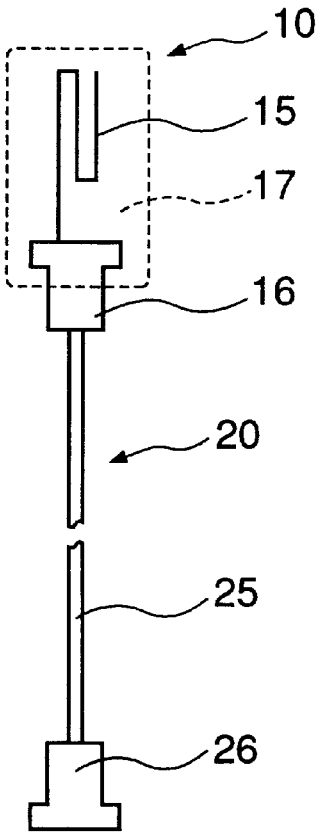
Figure 6B:
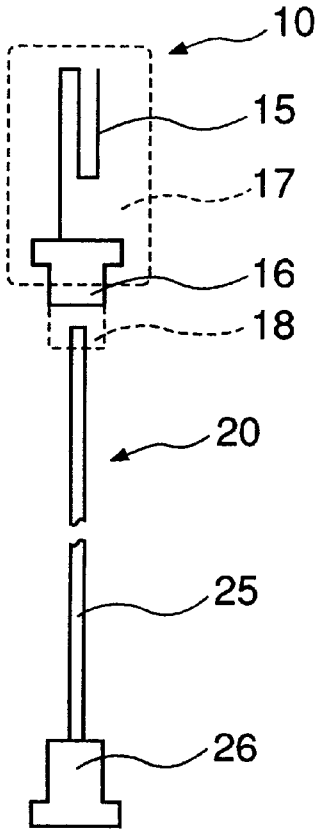
FIG. 6*b* shows the case where the first and second antenna portions are electrically coupled capacitively and/or inductively.
Figure 6C:
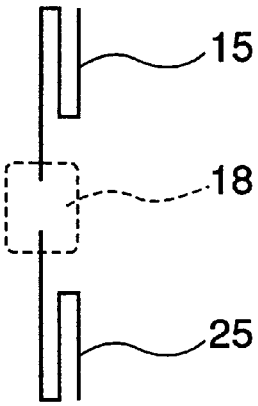
FIG. 6*c* shows the case where the first and second antenna portions are disconnected electrically by an insulation substance.

FIGS. 6*a*, 6*b* and 6*c* show an example of top coil type, in which the first antenna portion 10 is loaded on the upper portion of the second antenna portion 20. In more detail, in the first antenna portion 10, an end of the first antenna element 15 of the present invention in which the return portions are formed is connected to a metal fixture 16. Therefore, when the second antenna portion 20 is retracted into the casing, the metal fixture 16 is connected to the feeder portion of the casing. Further, in the second antenna portion 20, a stopper 26 is attached to one end of the second antenna element 25. Therefore, when the second antenna portion 20 is extended from the casing, this stopper 26 is connected to the feeder portion of the casing. The length of the first antenna element 15 is normally set to a substantially ¼ wavelength of the first frequency band f1 (e.g., 900 MHz), and the length of the second antenna element 25 is normally set to a substantially ½ wavelength of the first frequency band f1 (e.g., 900 MHz). However, it is also possible to set the substantial length of the second antenna element 25 to a substantially ¼ wavelength of the first frequency band f1 by providing a matching circuit on the casing side. Further, in the example shown in FIG. 6*a,* the metal fixture 16 of the first antenna portion 10 is directly connected to the upper end of the second antenna portion 20 electrically; and in the example shown in FIG. 6*b,* the metal fixture 16 of the first antenna portion 10 is fixed to the upper end of the second antenna portion 20 by use of an electrically insulating material 18, and coupled to each other electrically on the basis of capacitive or inductive coupling. Further, in FIGS. 6*a* and 6*b,* a top 17 formed of a resin is attached to the first antenna element 15 for covering it.

FIG. 6*c* is a diagram showing an example of the antenna according to the present invention, in which the second antenna portion is also formed with the returned portions. Further, in FIG. 6*c,* although the first and second antenna portions 10 and 20 are isolated from each other electrically by use of an insulating substance 18, it is of course possible to connect both the antenna portions electrically by a mechanical direct contact between both. Further, when the first and second antenna portions 10 and 20 both formed with the returned portions, respectively are perfectly separated electrically from each other, although the sizes of the first and second antenna elements 15 and 25 are the same in both in the case shown in FIG. 6*c,* it is possible to reduce the number of returns of the second antenna element 25 and to increase the external dimension thereof. In this case, when the second antenna portions 20 is pulled out of the casing, only the extended second antenna portion 20 can function as an antenna which can increase the sensitivity during communications, as compared with when only the first antenna portion 10 is used. In this case, it is possible to transmit and receive radio signals in plural frequency bands, while reducing the antenna length.

In the case of the radio apparatus such as portable telephone sets, it is preferable that a multi-frequency band can be transmitted and received by use of a small-sized antenna. When the antenna according to the present invention as described above is used, it is possible to obtain a small-sized radio apparatus, which is convenient when the apparatus is being carried and which can transmit and receive multi-frequency bands. In other words, in the radio apparatus, the transmit and receive circuit is housed in the casing, and the antenna is connected to the transmit and receive circuit electrically via a feeder portion disposed in the casing. Therefore, when the antenna according to the present invention as shown in FIGS. 3*a* to 6*c* is connected to the casing as it is, it is possible to obtain a radio apparatus according to the present invention. Further, without being limited only to the antenna as shown in FIGS. 3*a* to 6*c,* when the antenna as shown in FIG. 1 is used as the whole or a part of the antenna of the radio apparatus, it is possible to obtain a small-sized radio apparatus which can transmit and receive multi-frequency bands at a high sensitivity.

As described above, in the antenna according to the present invention, since the antenna element of a long conductor is formed by returning it so as to extend in parallel to the longitudinal direction thereof, it is possible to shorten the total external physical length of the antenna without deteriorating the radiation characteristics of the antenna.

Further, since the antenna can be resonated at the frequency bands even- or odd-times higher than a frequency band or in the vicinity of the higher frequency bands on the basis of the capacitive coupling and mutual function of the adjacent returned antenna element pieces, it is possible to transmit and receive multi-frequency band signals by use of a single antenna element, without connecting plural antenna elements for two or more frequency bands (other than the odd-number frequency bands) via a trap or traps.

Further, in the antenna suitable for use with a portable apparatus according to the present invention, the size of the antenna for receiving only a call signal can be reduced markedly, without deteriorating the antenna performance. Further, when the antenna element is formed by a belt-shaped member, it is possible to obtain an antenna simple in manufacturing process, small in size, and high in antenna characteristics.

SECOND EMBODIMENT

A second embodiment of the antenna of the present invention suitable for use with a portable apparatus (e.g., a portable telephone set) will be described in detail hereinbelow with reference to the attached drawings. Here, the antenna is composed of a first antenna portion formed with the returned portions and a second antenna portion extended into contact with the first antenna portion electrically only during communications.

Figure 7A:
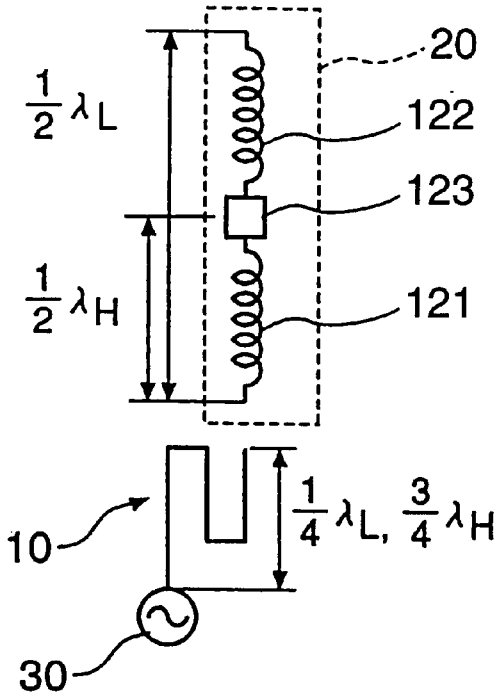

FIG. 7*a* is a conceptional view showing the structure of the antenna of the present embodiment. In FIG. 7*a,* the first antenna portion 10 is obtained by returning a long conductor in the longitudinal direction thereof in the same way as in FIG. 1. Here, since the returned portions are formed in the first antenna portion 10, the total length thereof is such that the electrical length thereof is substantially ¼ wavelength ($\lambda_L/4$) of the first frequency band (e.g., 900 MHz) and further ¾ wavelength ($3\lambda_L/4$) of the second frequency band (e.g., 1800 MHz twice higher than the first frequency band). As a result, the first antenna portion 10 can transmit and receive both the first and second frequency bands (about twice relationship between both) and the odd-number frequency bands of each of these two frequency bands. Further, in FIG. 7*a,* an end of the first antenna portion 10 is connected to a feeder portion 30.

Further, the second antenna portion 20 is housed in a casing (not shown) when carried, but extended from the casing and thereby connected electrically to the first antenna portion 10 to increase the sensitivity thereof during communications.

In FIG. 7*a,* the second antenna portion 20 is composed of a first antenna element 121 having an electrical length of substantially ½ wavelength ($\lambda_H/2$) of the second frequency band, a second antenna element 122 connected to the first antenna element 121 and having substantially ½ wavelength ($\lambda_L/2$) of the first frequency band in total together with the first antenna element 121, and an impedance element 123 for connecting both the antenna elements 121 and 122 at an intermediate portion thereof. In the second antenna portion 20 constructed as described above, the first antenna element 121 functions as an antenna of about ½ wavelength ($\lambda_H/2$) of the second frequency band, and both the first and second antenna elements 121 and 122 function as an antenna of about ½ wavelength ($\lambda_L/2$) of the first frequency band, respectively, as shown in FIG. 7*a*.

Figure 7B:
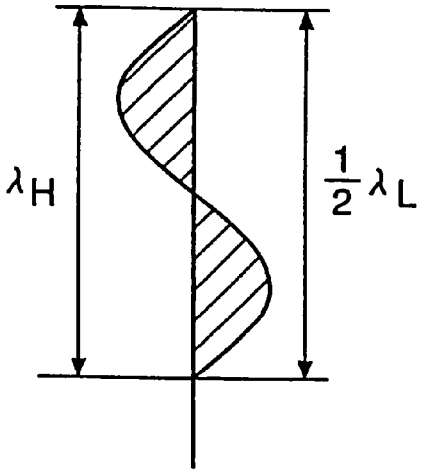

Here, when the first and second antenna elements 121 and 122 are connected directly to each other, since the electrical lengths of both the first and second antenna elements 121 and 122 become one wavelength ($\lambda_H$) of the second frequency band, as shown in FIG. 7*b,* the phase of the waveform is reversed and thereby canceled with each other in total, so that the sensitivity thereof is reduced. To overcome this problem, in the present embodiment, the impedance element 123 is connected between the two antenna elements 121 and 122 of the second antenna portion 20.

Figure 8A:
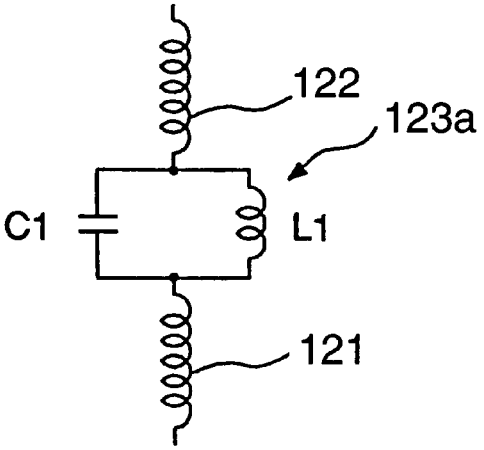
FIG. 8*a* is a circuit diagram showing an impedance element (trap circuit) composed of an inductor and a capacitor and connected between the first and second antenna elements of the second antenna portion.
Figure 8B:
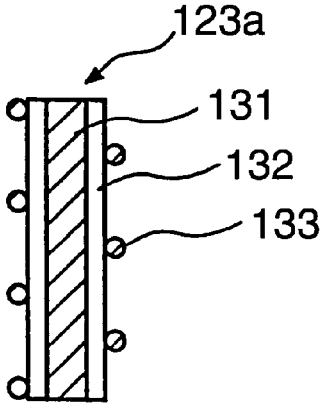
FIG. 8*b* is a cross-sectional view showing the same trap obtained by winding a conductor around an insulating substance.

As shown in FIG. 8*a,* this impedance element 123 is a trap 123*a* constructed by a parallel resonance circuit for the second frequency band, which is composed of an inductor element having an inductance L1 and a capacitor element having a capacitance C1. Therefore, since the impedance of the trap 123*a* is infinite for the second frequency band, the second antenna element 122 can be electrically separated from the first antenna element 121, so that the electrical length of only the first antenna element 121 becomes ½ wavelength ($(\lambda_H/2)$ of the second frequency band. Further, since the trap 123 does not function as a parallel resonance circuit for the first frequency band, the second antenna element 122 is not electrically separated from the first antenna element 121, so that both the first and second antenna elements 121 and 122 can function as an antenna having ½ wavelength ($(\lambda_L/2)$ of the first frequency band. Further, this trap 123*a* can be formed by winding a coil 133 around an insulating substance 132 (e.g., polyethylene) which covers a conductor 131 (e.g., copper), as shown in FIG. 8*b.*

Figure 9A:
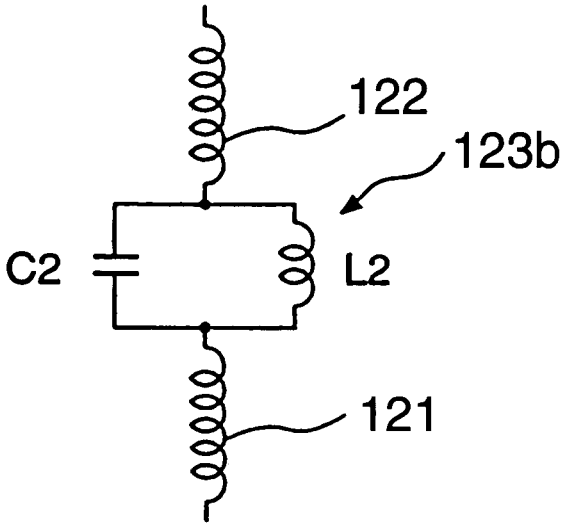
FIG. 9*a* is a circuit diagram showing another impedance element (phase shifter) composed of an inductor and a capacitor and connected between the first and second antenna elements of the second antenna portion.
Figure 9B:
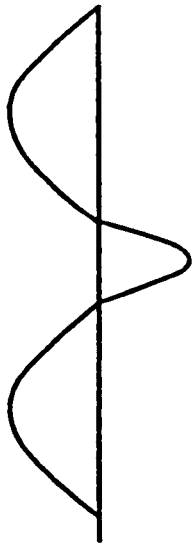
FIG. 9*b* is an illustration showing the current distribution of the phase shifter.

FIG. 9*a* shows another modification of the antenna of the second embodiment, in which the impedance element 123 is used as a phase shifter 123*b* for shifting the phase of the second frequency band by 180 degrees. As indicated by an equivalent circuit shown in FIG. 9*a,* the phase shifter 123*b* is composed of an inductor element having an inductance L2 and a capacitor element having a capacitance C2 connected in parallel to each other. The inductance L2 and the capacitance C2 of the phase shifter 123*b* are so adjusted that the electrical length thereof is ½ wavelength of the second frequency band, whose operation is different from that of the trap 123*a.* That is, since the phase of the second frequency band signals is reversed by the phase shifter 123*b,* as shown by a current distribution in FIG. 9*b,* the same phase can be obtained at the first and second antenna elements 121 and 122 in the case of the second frequency band. Therefore, both the first and second antenna elements 121 and 122 can function as an antenna also for the second frequency band, so that the sensitivity of the antenna can be increased markedly as a whole.

The first antenna portion 10 and the second antenna portion 20 can be coupled electrically by a direct contact or by an indirect contact (capacitive or inductive coupling) between one end (on the feeder portion side) of the second antenna portion 20 and the other end (the opposite side of the feeder portion side) of the first antenna portion 10, whenever the second antenna portion 20 is extended from the casing. Therefore, when both the first and second antenna portions 10 and 20 are connected capacitively or inductively, since the current distribution is reversed by 180 degrees at the coupling portion, the first antenna portion 10 having an electrical length of about ¼ wavelength of the first frequency band and the second antenna portion 20 having an electrical length of about ½ wavelength of the first frequency band are in phase with each other and thereby the current distributions thereof can be strengthened each other, with the result that it is possible to obtain an excellent antenna of high radiation characteristics.

On the other hand, when the first antenna portion 10 having an electrical length of about ¼ wavelength of the frequency band and the second antenna portion 20 having an electrical length of about ½ wavelength of the frequency band are connected to each other directly, since the phase thereof is not reversed at the junction point between both; that is, since the phase is reversed only at both the antenna portions, the sensitivity is slightly reduced. With these problems in mind, the following modifications can provide a coupling structure of both the antenna portions having a high coupling efficiency.

Figure 10A:
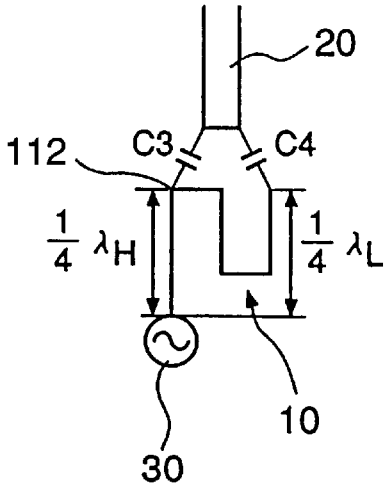

First, when coupled capacitively or inductively, as shown in FIG. 10*a,* the first antenna portion 10 is formed with a coupling returned portion 112 at the electrical length portion of about ¼ wavelength ($\lambda_H/4$) of the second frequency band. Further, the second antenna portion 20 is coupled to the first antenna portion 10 at the coupling returned portion 112 via a capacitance C3 for the second frequency band; and the second antenna portion 20 is coupled to the first antenna portion 10 at an end of the total length ($\lambda_L/4$) of the first frequency band via a capacitance C4 for the first frequency band. By the above-mentioned construction, it is possible to couple the first and second antenna portions 10 and 20 electrically in phase with each other for both the first and second frequency bands. In this case, since both the current distributions can be strengthened with each other, it is possible to couple both the first and second antenna portions 10 and 20 at a high efficiency.

Figure 10B:
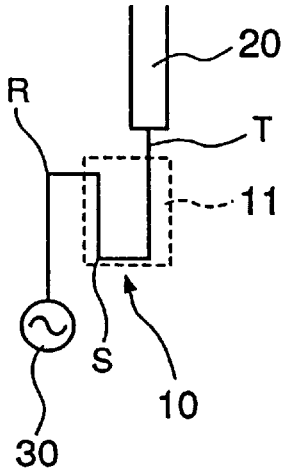
Figure 10C:
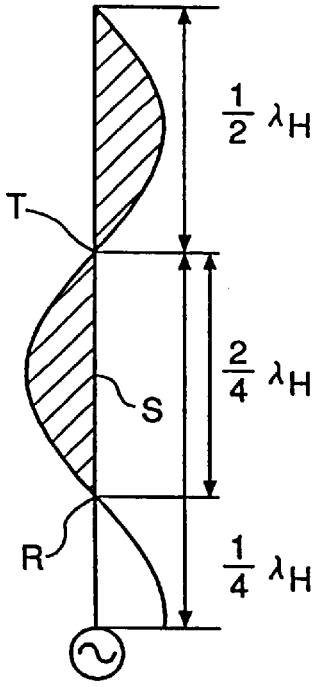
FIG. 10*c* is an illustration showing a current distribution of the first and second antenna portions shown in FIG. 10*b;*
Figure 10D:
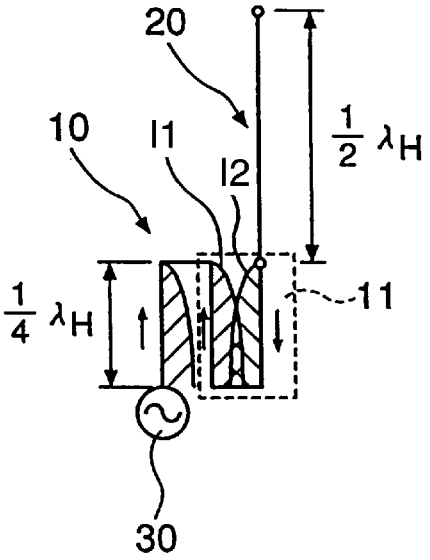
FIG. 10*d* is an illustration showing a current distribution of the first antenna portion shown in FIG. 10*b;*
Figure 10E:
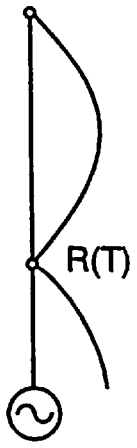
FIG. 10*e* is an illustration showing a current distribution of the first antenna portion shown in FIG. 10*b;*

On the other hand, as shown in FIG. 10*b,* when the first and second antenna portions 10 and 20 are connected directly, if the electrical length of the first antenna portion 10 is about ¼ wavelength of the high frequency band, since the phase is reversed, the sensitivity is reduced. On the other hand, if the electrical length of the first antenna portion 10 is about ¾ wavelength of the high frequency band, as indicated by the current distribution curve shown in FIG. 10*c,* since the phase of the current distribution at the electrical length of ¾ wavelength ($2\lambda_H/4$) of the first antenna portion 10 and the phase of the current distribution at the electrical length of ½ wavelength ($\lambda_H/2$) of the second antenna portion 10 are reversed and thereby canceled with each other, the antenna cannot function as a coupling antenna. Therefore, in the case of the direct connection between the two antenna portions 10 and 20, even if both the antenna portions 10 and 20 are connected as they are, the coupled antenna cannot function for the two frequency bands and further the sensitivity thereof decreases for one frequency band. However, when the first antenna portion 10 is formed in such a way that the electrical length thereof is about ¾ wavelength, and further when the returned portions are formed in the first antenna portion 10 in such a way that the electrical length portion of ¾ wavelength serves as a phase shifter 11, it is possible to improve the antenna characteristics. In more detail, as indicated by two current distributions I1 and I2 shown in FIG. 10*d,* when the returned portions are formed in such a way that the current distribution directions can be reversed (as shown by hatched lines) by opposing the two portions at which the magnitudes of the currents passing through the lines of the ¾ wavelength portions of the first antenna portion 10 are the same with respect to each other, since the currents at the ¾ wavelength portions are canceled with each other, it is possible to form only a phase shifter. As a result, even if the first and second antenna portions 10 and 20 are directly connected to each other, it is possible to allow the electrical length portion of about ¼ wavelength of the first antenna portion 10 to be in phase with the electrical length portion of about ½ wavelength of the second antenna portion 20, as shown in FIG. 10*e,* so that it is possible to couple the two antenna portions 10 and 20 at a high coupling efficiency. Therefore, when the first and second antenna portions 10 and 20 are directly connected as an antenna for transmitting and receiving the high frequency band, it is preferable that the returned portions are formed in such a way that the electrical length of the first antenna portion 10 is set to about ¾ wavelength of the frequency band and further that the electrical length portions of ¾ wavelength can be canceled with each other. Further, in FIGS. 10*c* and 10*e*, R, S, and T indicate the positions designated by R, S and T of the first antenna portion 10 shown in FIG. 10*b*.

On the other hand, when the antenna for transmitting and receiving two frequency bands is formed by directly connecting the first and second antenna portions 10 and 20, the returned portions are formed in such a way that the total length thereof corresponds to the electrical length of about ¼ wavelength of the first frequency band and to the electrical length of about ¾ wavelength of the second frequency band and further that the electrical length portions of ¾ wavelength can be canceled with each other. In this case, the coupling efficiency of this antenna is high in the second frequency band, as described already. On the other hand, since there exists a small phase difference between the first and second antenna portions 10 and 20 in the first frequency band, although the sensitivity is slightly lowered, this antenna can be used for the first frequency band (because not canceled perfectly). In this case, when the first antenna portion 10 is formed with the returned portions in such a way that a phase shifter can be formed for the second frequency band, since the currents passing through the electrical length portions of ¾ wavelength of the second frequency band can be canceled with each other (the current directions are reversed at the large current portions), the components thereof are almost lost. However, in the first frequency band, since the current directions are not reversed at the same current value and further since the large current portions are not canceled with each other on the feeder portion (30) side, this antenna can function as an antenna even if returned.

Figure 11A:
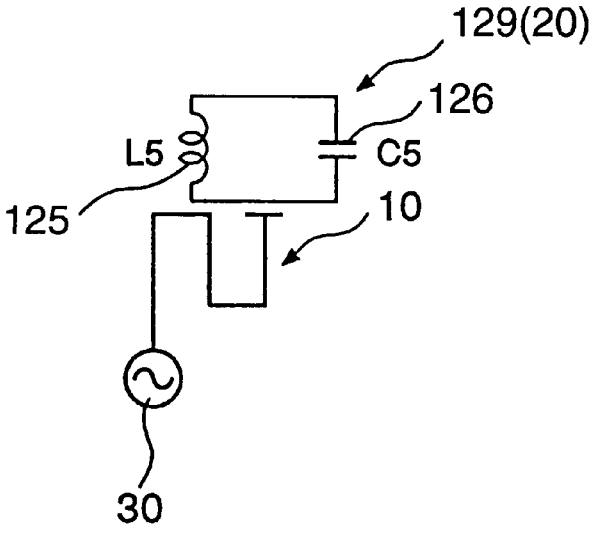
Figure 11B:
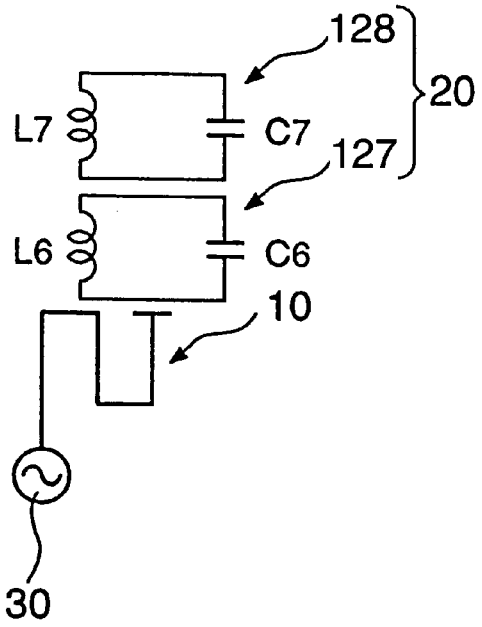
FIG. 11*b* shows the case where the first and second antenna elements of the second antenna portion are formed by two series resonance circuits.

FIGS. 11*a* to 11*d* show still the other modifications of the antenna of this embodiment, by which the total antenna length can be shortened even when the second antenna portion 20 is extended from the casing and in addition the second antenna portion can be extended and retracted by a single touch. In more detail, in the antennas shown in FIGS. 11*a* to 11*d*, the second antenna portion 20 is formed by a series resonance circuit 129 of a closed loop composed of an inductor element 125 and a capacitor element 126. In FIGS. 11*a* and 11*b*, the first antenna portion 10 is of returned antenna as shown in FIG. 1. Further, FIG. 11*a* shows an example of the antenna for transmitting and receiving the first frequency band and the other frequency bands odd-number times higher than the first frequency band. On the other hand, FIG. 11*b* shows an example of the antenna for transmitting and receiving the first frequency band and the other frequency bands even-number times higher than the first frequency band.

Figure 11C:
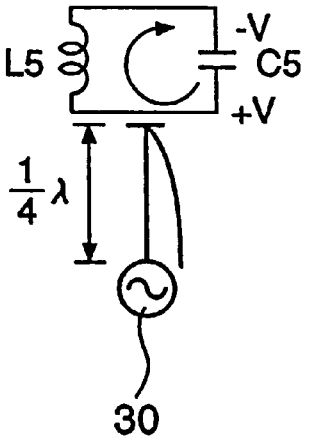
FIG. 11*c* shows the case where the first and second antenna portions are coupled with each other capacitively and/or inductively.

In FIG. 11*a*, the total electrical length of the first antenna portion 10 is substantially ¼ wavelength of the first frequency band. On the other hand, the second antenna portion 20 is a series resonance circuit 129 of a closed loop composed of the inductor element 125 having an inductance L5 and the capacitor element 126 having a capacitance C5 (L5 and C5 are so determined as to be series-resonated at the first frequency band). Therefore, as shown by FIG. 11*c*, since the first antenna portion 10 is resonated at the electrical length of substantially ¼ wavelength ($\lambda/4$) of the first frequency band, the current is maximized on the feeder portion (30) side. On the other hand, since the second antenna portion 20 is series resonated in the first frequency band, the maximum transmitted and received current flows therethrough. Therefore, when the first and second antenna portions 10 and 20 are coupled capacitively or inductively, a high sensitivity can be obtained in both transmission and reception.

In FIG. 11*b*, the first antenna portion 10 is formed with the returned portions in such a way that the first frequency band of 900 MHz and the second frequency band of 1800 MHz can be transmitted and received at the same time. Further, the second antenna portion 20 is made up of a first series resonance circuit 127 of a closed loop composed of an inductor element having an inductance L6 and a capacitor element having a capacitance C6 (L6 and C6 are so determined as to be series-resonated in the first frequency band) and a second series resonance circuit 128 of a closed loop composed of an inductor element having an inductance L7 and a capacitor element having a capacitance C7 (L7 and C7 are so determined as to be series-resonated in the second frequency band). Further, the first and second series resonance circuits 127 and 128 are coupled with each other capacitively or inductively. In this case, it is preferable to provide the first series resonance circuit 127 series resonated in the first (lower) frequency band in the vicinity of the first antenna portion 10. This is because since the capacitance C6 can be increased and thereby the impedance can be reduced in the second frequency band, the second series resonance circuit 128 can be easily coupled with the first antenna portion 10.

Figure 11D:
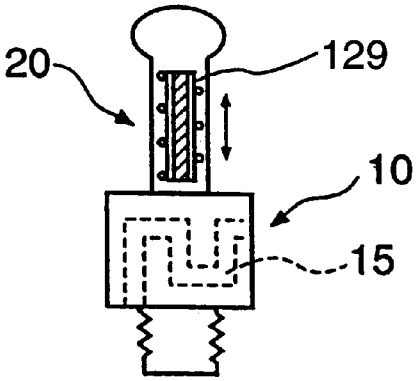
FIG. 11*d* shows the case where the second antenna portion is formed as a single touch antenna.

The above-mentioned series resonance circuits 127 to 129 can be constructed by winding a coil around an insulation substance (e.g., polyethylene) for covering a conductor (e.g., copper wire), as already explained with reference to FIG. 8*b*. Therefore, the total length of the second antenna portion 20 can be reduced as short as about 9 mm. This length is very short as compared with the coiled second antenna portion longer than 50 mm (as shown in FIGS. 7*a* to 10*e*). As a result, as shown in FIG. 11*d*, the second antenna portion 20 can be slidably inserted into the cylindrical first antenna portion 10 in such a way that the second antenna portion 20 can be extended or retracted from and into the casing by a single hand easily with the use of a button, for instance. In this case, the first antenna portion 10 is formed by a cylindrical insulating substance and a belt-shaped antenna element 15 disposed on an outer circumference of the insulating substance, and the second antenna portion 20 is formed by a closed loop series resonance circuit protected by a resin therearound. Further, since being very short, even if the second antenna portion 20 is fixed in connection with the first antenna portion (without extending and retracting from and into the casing), this antenna is short enough not to be obstructive. In this case, the reception sensitivity to a call signal can be improved, and further the transmission and reception can be made as it is as a high sensitivity even during communications.

As described above, in the antenna according to the present embodiment, since the returned antenna is used for the first antenna portion so as to be connected to the second antenna portion electrically during communications, it is possible to receive a call signal by the first short antenna portion and further to obtain a high sensitivity together with the second antenna portion during communications.

Further, since the first antenna portion is formed with the returned portions in such a way two frequency bands of even number times relationship can be transmitted and received, since the first antenna portion can be coupled with the second antenna portion electrically via a phase shifter for preventing cancellation or by shifting the coupled position, and further since the elements of the second antenna portion are connected to each other via a trap or a phase shifter for prevention of cancellation in the twice higher frequency bands, it is possible to transmit and receive the frequency band signals of even-number times relationship at a high sensitivity.

Further, since the second antenna portion is formed by a series resonance circuit, the size of the second antenna can be reduced markedly, so that the second antenna portion can be extended or retracted from and into the casing simply by use of a button, that is, by a single touch operation. Further, the second antenna portion can be shortened markedly, it is possible to obtain a small-sized antenna, which is not obstructive even if the second antenna is kept fixed to the casing as it is in the extended state.

THIRD EMBODIMENT

Prior to the description of the third embodiment, a problem related to the antenna according to the present invention will be explained hereinbelow with reference to FIGS. 12*a* to 12*c*.

Figure 12A:
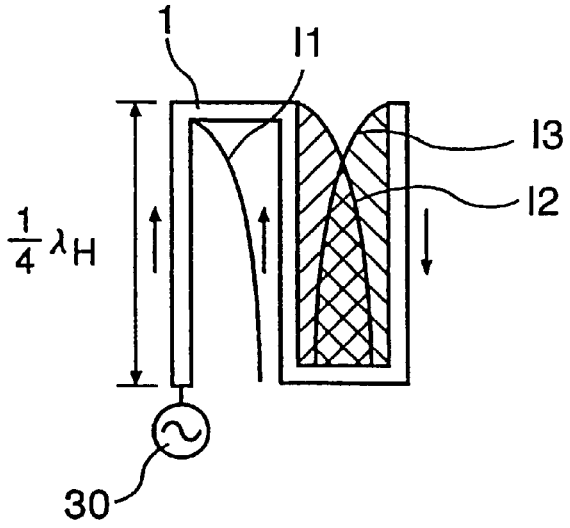
Figure 12B:
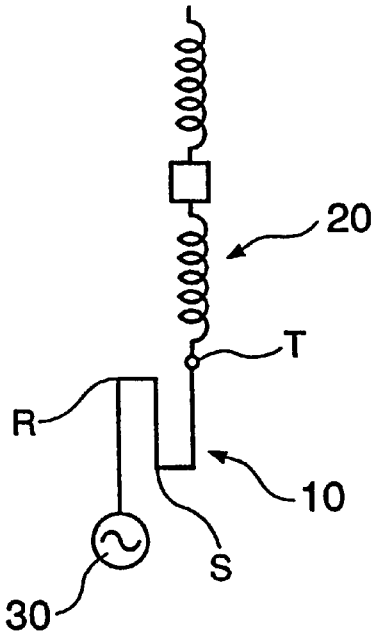
FIG. 12*b* shows the cancellation of the current distributions when the extended second antenna portion is directly connected to the first antenna portions.
Figure 12C:
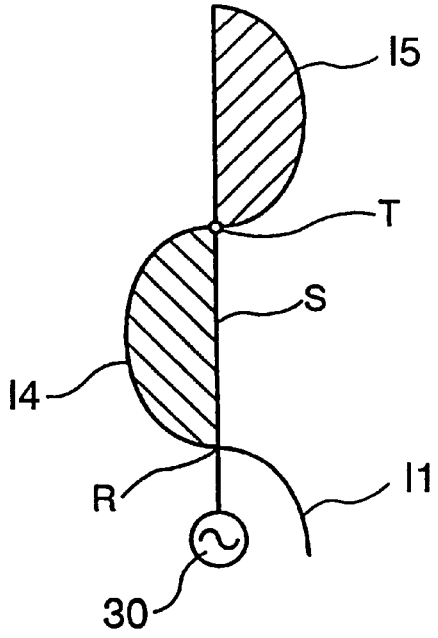
FIG. 12*c* is a current distribution curve obtained in the antenna shown in FIG. 12*b;*

When the antenna is formed as a three-folded antenna element, as indicated by current distributions I1, I2 and I3 as shown in FIG. 12*a*, since the magnitudes of the current distributions I2 and I3 are the same in both but the directions thereof are opposite to each other at the electrical length portions of ¾ wavelength in ¾ wavelength ($\lambda_H$) of the second frequency band, the two current distributions I2 and I3 are canceled with each other (at the portions hatched in FIG. 12*a*), there arises a problem in that the current components are reduced. Further, as shown in FIG. 12*b*, when the second antenna portion 20 is extended during communications and connected to the first antenna portion 10 electrically, as indicated by the respective current distributions I1, I4 and I5 shown in FIG. 12*c*, since the current distribution I4 of the electrical length portion of ¾ wavelength of the first antenna portion 10 is out of phase with the current distribution I5 of the electrical length portion of ½ wavelength of the second antenna portion 20, the two current distributions I4 and I5 are canceled with each other, so that the sensitivity is reduced. Further, R, S and T shown in FIG. 12*c* designate the positions denoted by R, S and T of the first antenna portion shown in FIG. 12*b*. Further, the reference numeral 30 in FIG. 12*b* denotes a feeder portion. In this third embodiment, therefore, the shape of the returned antenna is improved to overcome the above-mentioned problem.

Figure 13A:
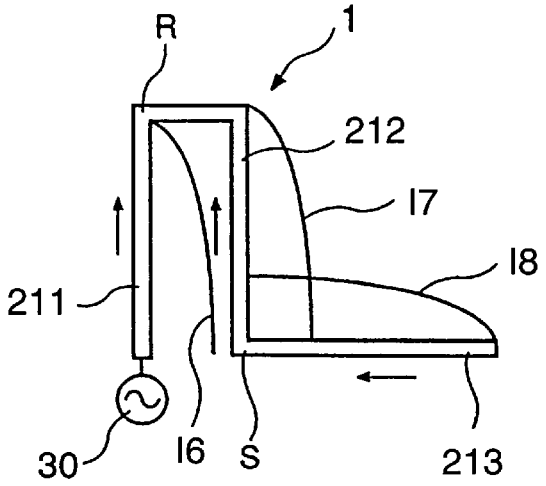
Figure 13B:
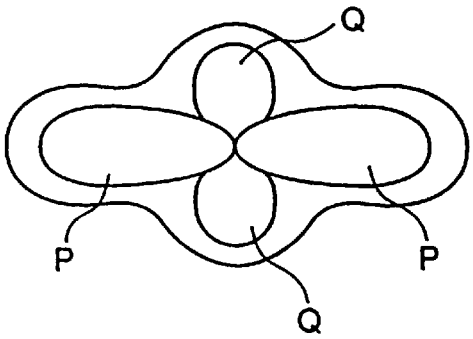
Figure 13C:
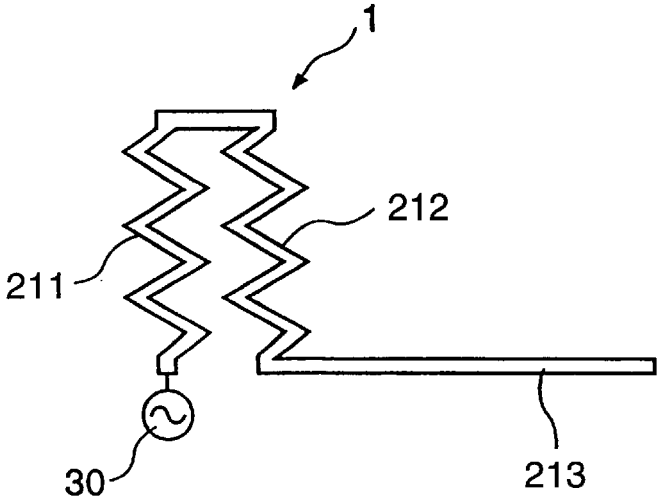
* and FIG. 13*c* shows a modification of the antenna shown in FIG. 13*a;*

FIGS. 13*a*, 13*b* and 13*c* show the third embodiment of the returned antenna according to the present invention, which can prevent the current distributions at the ¾ wavelength portions from being canceled with each other (because the current magnitudes are the same and the current directions are opposite to each other) at the two adjacent antenna elements, when the returned antenna is formed so as to transmit and receive twice frequency band signals.

In FIG. 13*a*, the antenna element 1 is composed of first to third elements 211, 212 and 213, and further the third element 213 is turned in the direction perpendicular to the first and second elements 211 and 212, without returning the third element 213 substantially in parallel to the first and second elements 211 and 212 at the second returned portion S. Therefore, the antenna is formed in such a way that the electrical length is about ¼ wavelength of the first frequency band in total, and the first returned portion R between the first and second elements 211 and 212 is adjusted in such a way that the antenna can be resonated at about ¾ wavelength of the second frequency band about twice higher than the first frequency band. Further, the third element 213 is extended in such a direction that the second returned (turned) portion S does not function mutually with the first and second elements 211 and 212. In other words, the first antenna element 211 of the antenna element 1 formed with two returned portions S and R is so formed that the electrical length thereof is about ¼ wavelength of the second frequency band; the second element 212 is also so returned that the electrical length thereof is about ¼ wavelength thereof; and the third element 213 is also so turned that the electrical length thereof is about ¼ wavelength thereof, with the result that the antenna element 1 can be resonated at the electrical length of about ¾ wavelength of the second frequency band in total.

As a result, the current directions of the first and second elements 211 and 212 are the same (as shown by two arrows in FIG. 13*a*), so that the two current distributions I6 and I7 are represented in the same direction as shown in FIG. 13*a*. Therefore, the gain pattern is strengthened on both sides in the horizontal direction, as shown by P in FIG. 13*b*. On the other hand, since the third element 213 extends in the direction perpendicular to the first and second elements 211 and 212, the gain pattern Q thereof is represented on both sides in the vertical direction. That is, when both the gain patterns are synthesized, roughly a spherical gain pattern can be obtained, so that this antenna can be used as an orthogonal polarized wave antenna. In summary, in this antenna, the resonated currents of the second and third elements 212 and 213 are not only prevented from canceling with each other, but also the gain Q in the direction perpendicular to the gain P can be increased, with the result that it is possible to obtain a gain pattern suitable for a portable telephone set, in particular.

In the embodiment shown in FIG. 13*a*, although the first and second antenna elements 211 and 212 are shown as a straight element, respectively, when the antenna height is required to be reduced, it is possible to form the antenna elements 211 and 212 into zigzag form as shown in FIG. 13*c*, to such an extent that a harmful influence is not exerted upon the antenna characteristics.

Further, the above-mentioned antenna element 1 is formed by a wire (e.g., copper wire, piano wire, etc.) or by punching a metal plate (e.g., copper) or by a belt-shaped element (thin and broad) formed by etching a thin film formed in accordance with vapor deposition. Further, these antenna elements are not necessarily formed into a plane shape. For instance, the antenna elements can be formed into a ring shape as a whole on the outer circumference surface of a cylindrical insulating member. In this structure, since the second antenna portion can be extended and retracted from and into a central hollow portion formed in the cylindrical first antenna portion, it is possible to further reduce the size of the antenna for a portable apparatus such that the second antenna is extended from the casing thereof only during communications.

Figure 14A:
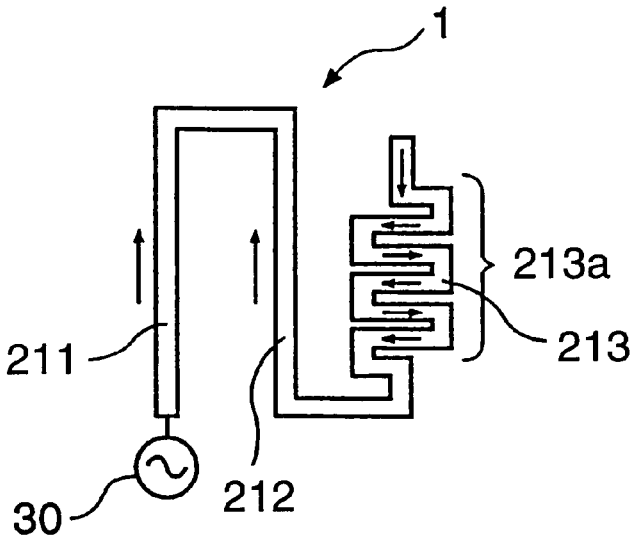

First and second modifications of the third embodiment will be described hereinbelow with reference to FIGS. 14*a* and 14*b*. When there exists no space to extend the third element 213 in a direction perpendicular to the first and second elements 211 and 212 as shown in FIG. 13*a*, the antenna is constructed in such a way that the resonant current of only the third element 213 can be canceled, without canceling the resonant current of the second element 212. That is, as shown in FIG. 14*a*, the third element 213 extending as a whole in a direction parallel to the longitudinal direction of both the first and second elements 211 and 212 is formed with a plurality of small returned portions 213*a* of crank shape extending in a direction perpendicular to the longitudinal direction of both the first and second elements 211 and 212. Since the small returned portions 213*a* of crank shape are formed, the current distributions of the same degree can be reversed and thereby canceled with each other by these returned portions 113*a*. As a result, since the current components can be canceled at only the third element 213, only the current components of both the first and second elements 211 and 212 remain and further strengthened, so that the transmission and reception sensitivity can be improved. Further, as already explained, the first and second elements 211 and 212 can be each formed into a zigzag shape, as shown in FIG. 13*c*.

Figure 14B:
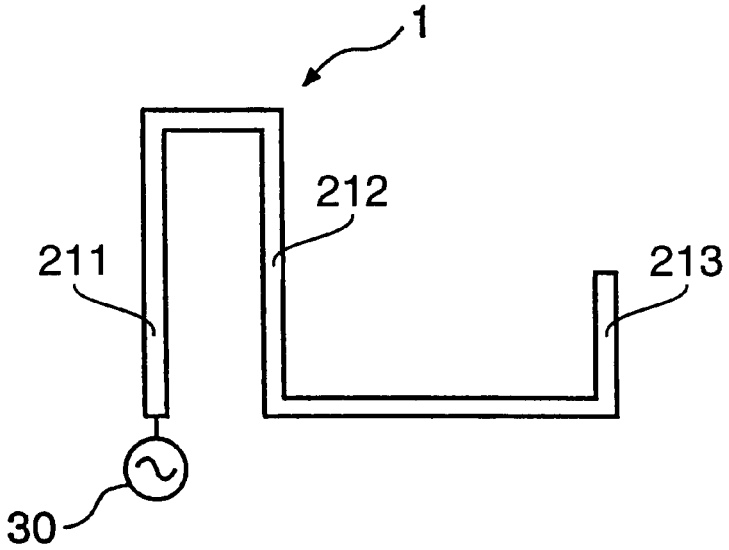

FIG. 14*b* shows a second modification, in which an end of the third element 213 is extended in the same direction as that of the second element 212. This modification indicates that as far as the third element 213 is substantially not parallel to the second element 212; that is, both the elements 212 and 213 are not coupled with each other capacitively or inductively, the third element 213 can be extended in the same direction as that of the second element 212. The distance between the second and third elements is about ⅛ wavelength or longer. In this modification, the space in the horizontal direction can be reduced as compared with that shown in FIG. 13*a,* and further first antenna element can be connected to the second antenna element more easily.

Figure 15:
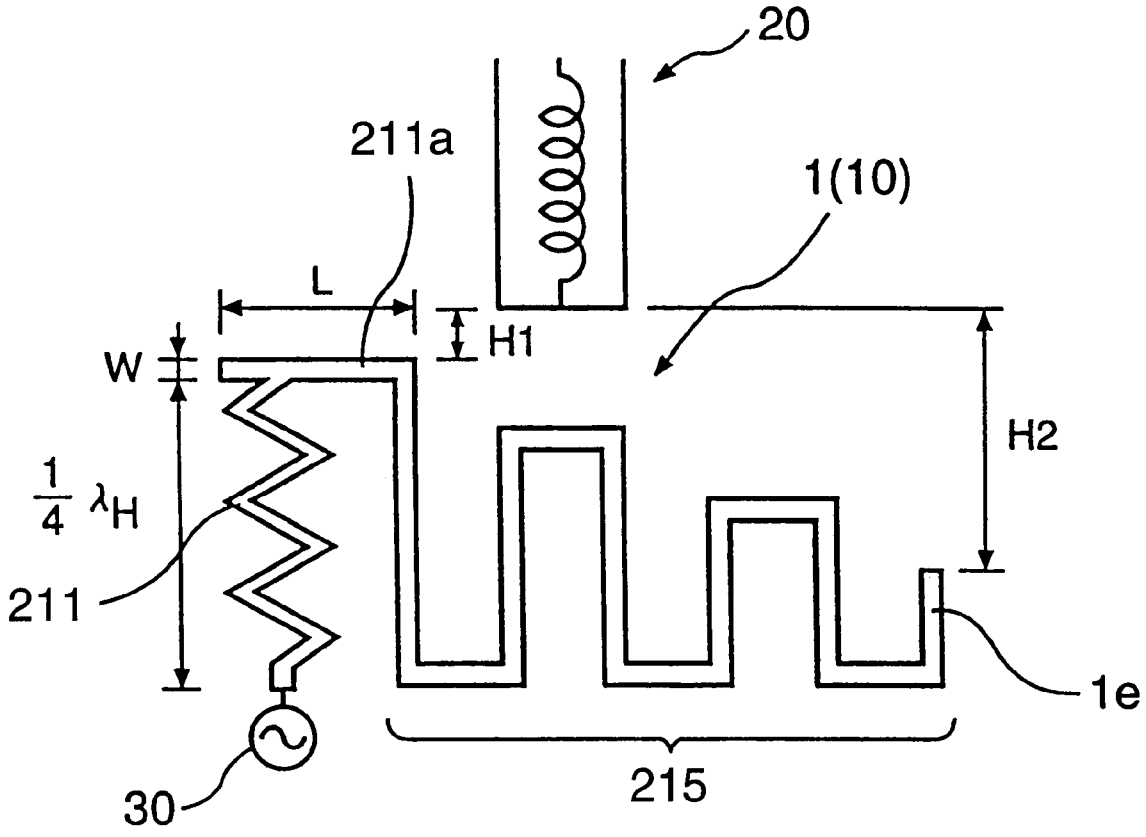
FIG. 15 is an illustrations showing another modification of the antenna having a coupling returned portion coupled with second antenna portion.

FIG. 15 shows a third modification. This antenna is suitable for a portable telephone, by which the second antenna portion 20 is extended from the casing and then connected to the first antenna portion 10 for receiving only a call signal electrically during communications and which can transmit and receive two or more frequency bands of twice relationship by use of a signal antenna at a high sensitivity.

In FIG. 15, the total length of the antenna element 1 (the first antenna portion 10) is formed so as to correspond to the electrical length of substantially ¼ wavelength of the first (lower) frequency band; the first element 211 is formed so as correspond to the electrical length of substantially ¼ wavelength of the second (higher) frequency band; and the first element 211 is formed with a coupling returned portion 211*a* on an end thereof on the opposite side to the feeder portion (30) side. This coupling returned portion 211*a* is formed so that a part thereof projects from the antenna element to increase an area thereof and thereby to facilitate the coupling with the second antenna portion 20. In the case where the second frequency band is 1800 MHz, for instance, the line width of this returned portion 211*a* is 0.7 to 1 mm (the same as that of the antenna element 1); the length L thereof is about 5 mm; and the distance H1 to the second antenna portion 20 is about 2 mm. The lengths and the number of the returned portions of the other elements 215 are determined in such a way that the total length together with the first element 211 is an electrical length of substantially ¼ wavelength of the first frequency band. Further, an end portion 1*e* of the other elements 215 of the antenna element 1 is formed a sufficient distance away electrically from the coupling returned portion 211*a* so as not to be coupled with the second antenna portion 20 electrically in the second frequency band. In more detail, a maximum voltage of +V is developed at the coupling returned portion 211*a* of the first antenna element 1 and a minimum voltage of −V is developed at the end portion 1*e* of the other elements 215 in the second frequency band. Therefore, when the distance between the coupling returned portion 211*a* and the end portion 1*e* of the other element 215 is close to each other, since both are coupled mutually with each other, the voltage +V developed at the first antenna portion 10 cannot be coupled with a voltage −V developed at an end of the second antenna portion 20. For this reason, the coupling returned portion 211*a* of the first element 211 is located in close vicinity to the second antenna portion 20 but far away from the end portion 1*e* of the other elements 215. In the case of the dimensions as explained when the second frequency band is 1800 MHz band, for instance, the distance H between the second antenna portion 20 and the end portion 1*e* is determined about 10 mm.

Figure 16A:
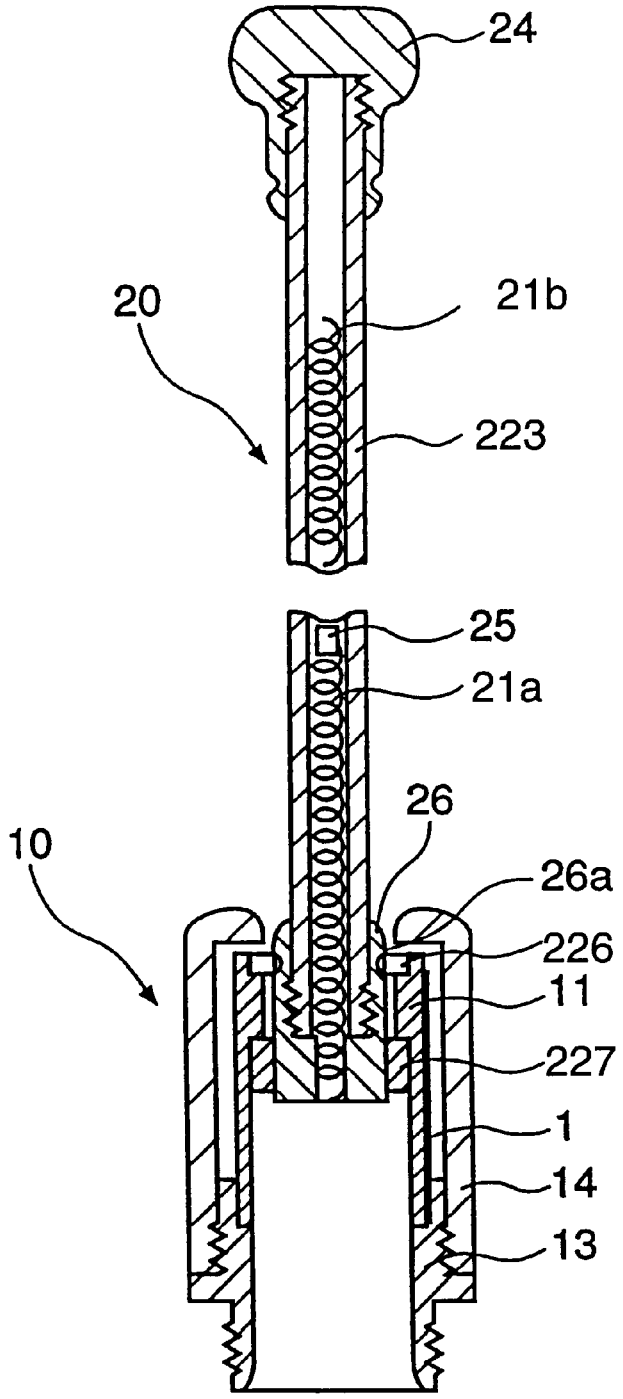
Figure 16B:
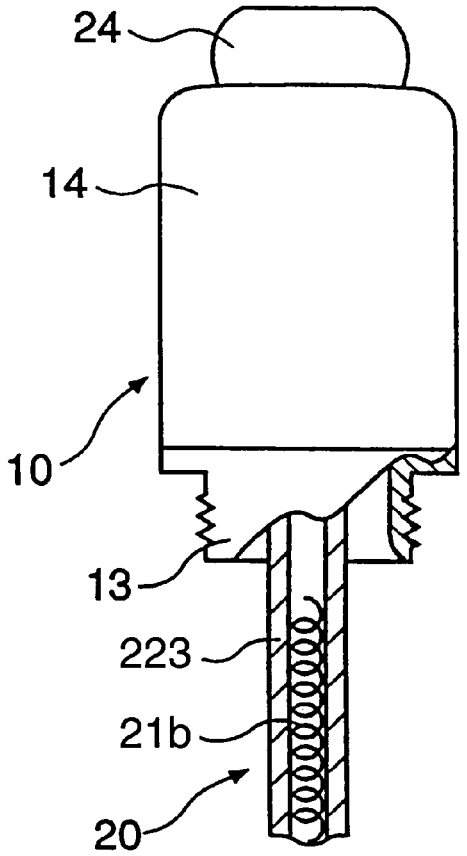

FIG. 16*a* shows a practical antenna in which the second antenna portion 20 is extended from the casing and FIG. 16*b* shows the practical antenna in which the second antenna portion 20 is retracted into the casing. In FIG. 16*a,* the first antenna portion 10 is formed by fixing an antenna element of a copper plate onto the outer circumferential surface of a cylindrical core (or bobbin) 11 of an insulating substance (e.g., PE, PC, PTFE, etc.). Further, the second antenna portion 20 is slidably moved along the central portion of the cylindrical core 11 in such a way as to be extendable and retractable from and to the casing. Therefore, since both the coupling returned portion 211*a* and the end portion 1*e* of the antenna element 1 shown in FIG. 15 are located on the outer circumferential surface of the core 11, both the coupling returned portion 211*a* and the end portion 1*e* are both equidistance away from the second antenna portion 20 disposed in the upper central portion of the core 11 in the radial direction of the core 11. Therefore, in order to adjust the coupling between the first and second antenna portions 10 and 20, the height of the second antenna portion 20 relative to the core 11 is adjusted. Further, as shown in FIG. 15, since the end portion 1*e* of the antenna element 1 is determined lower than the coupling returned portion 211*a,* the coupling strength at the end portion 1*e* is weaker than that at the coupling returned portion 211*a,* so that the first and second antenna portions 10 and 20 can be coupled with each other at only the coupling returned portion 211*a* for the second frequency band. On the other hand, in the case of the first frequency band, the maximum voltage +V is developed at only the end portion 1*e* of the antenna element 1 and easily coupled with the minimum voltage of −V developed at the end portion of the second antenna portion 20, without causing any problem even if the end portion 1*e* is a short distance away from the end portion of the second antenna portion 20. Further, in FIGS. 16*a* and 16*b,* the reference numeral 13 denotes a metal fixture of the first antenna portion 10; 14 denotes a cap formed of ABS (acrylic butadiene styrene), elastomer, etc. and screwed with the upper threaded portion of the metal fixture 13 to protect the antenna element 1. Further, 226 denotes a ring spring attached to the upper circumference of the core 11 and engaged with a notch 26*a* of a joint portion 26 formed at the lower portion of the second antenna portion 20, which is used as fixing means when the second antenna portion 20 is extended. Further, 21*b* denotes the first antenna element of the second antenna portion 20 having an electrical length of about ½ wavelength of the second frequency band; 21*a* denotes the second antenna element of the second antenna portion 20 having an electrical length of about ½ wavelength of the first frequency band and connected to the first antenna element 21*b* via a trap 25; 223 denotes a tube formed of a synthetic resin to protect these elements; 24 denotes a top serving as a knob when the second antenna portion 20 is extended; and 227 denoted a stopper for stopping the extended second antenna portion 20.

In the structure of the antenna as shown in FIG. 15, the antenna can be small-sized in such a way that the first antenna portion 10 is used for receiving a call signal and the first antenna portion 10 and the extended second antenna portion 20 are used during communications. Here, the extended second antenna portion 20 is electrically coupled with the end portion 1*e* of the antenna element 1 for the first frequency band and serves as a ¼ waveform antenna, and electrically coupled with the coupling returned portion 211*a* of the antenna element 1 for the second frequency band and serves as a ¼ waveform antenna (by only the first element 211). As a result, the first antenna portion 10 operates as a ¼ waveform antenna for both the first and second frequency band signals in cooperation with the second antenna portion 20 formed as a ½ wavelength antenna, so that the antenna of the present embodiment can operate as an antenna of high sensitivity for both the first and second frequency bands, without any cancellation.

As described above, in the antenna of the third embodiment, when the external dimensions of the antenna formed with the returned portions are reduced, since the antenna element is so formed that the ½ wavelength electrical length portions of the antenna which serves as a ¾ wavelength antenna are not canceled with each other, it is possible to transmit and receive signals at a high sensitivity when operating as an antenna of ¾ wavelength. As a result, it is possible to obtain an antenna which can transmit and receive two or more frequency bands of twice relationship by a single antenna at a high sensitivity.

Further, when the first antenna portion is coupled with the second antenna portion electrically to increase the sensitivity during communications, since the antenna element of the first antenna portion is formed with the coupling returned portion at the electrical length portion of about ¼ wavelength of the second frequency band in such a way that the coupling returned portion is used for the second frequency band and the end portion of the antenna element of the first antenna portion is used for the first frequency band, it is possible to transmit and receive both the frequency band signals at a high sensitivity without canceling and without any loss in each of the two frequency bands. As a result, a small-sized antenna suitable for use with the portable telephone set can be obtained for two or more frequency bands of twice relationship.

FOURTH EMBODIMENT

A fourth embodiment of the antenna according to the present invention will be described hereinbelow with reference to the attached drawings. The feature of this embodiment resides in a click structure of the antenna, which is suitable for use with a portable telephone set. In FIGS. 17*a* to 17*d* and FIGS. 18*a* to 18*b*, the antenna is composed of the first antenna portion 10 for receiving a call signal and the second (rod shaped) antenna portion 20 extended for use during communications.

Figure 17A:
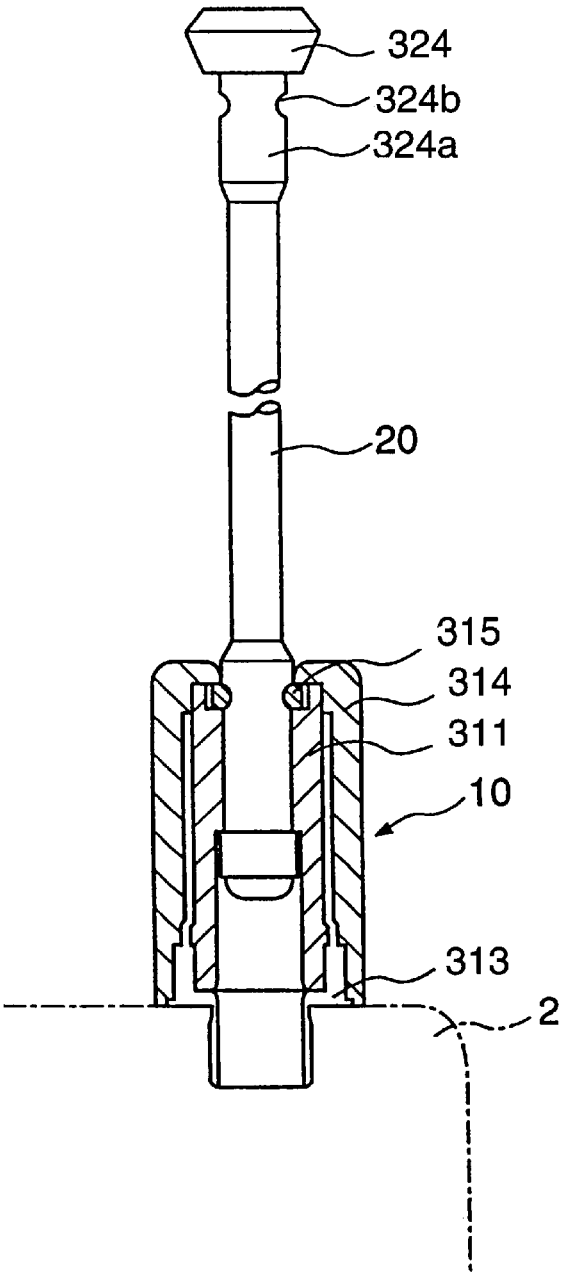
Figure 17B:
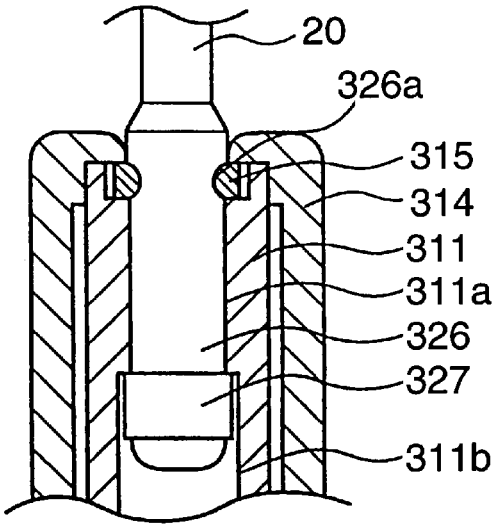
Figure 18A:
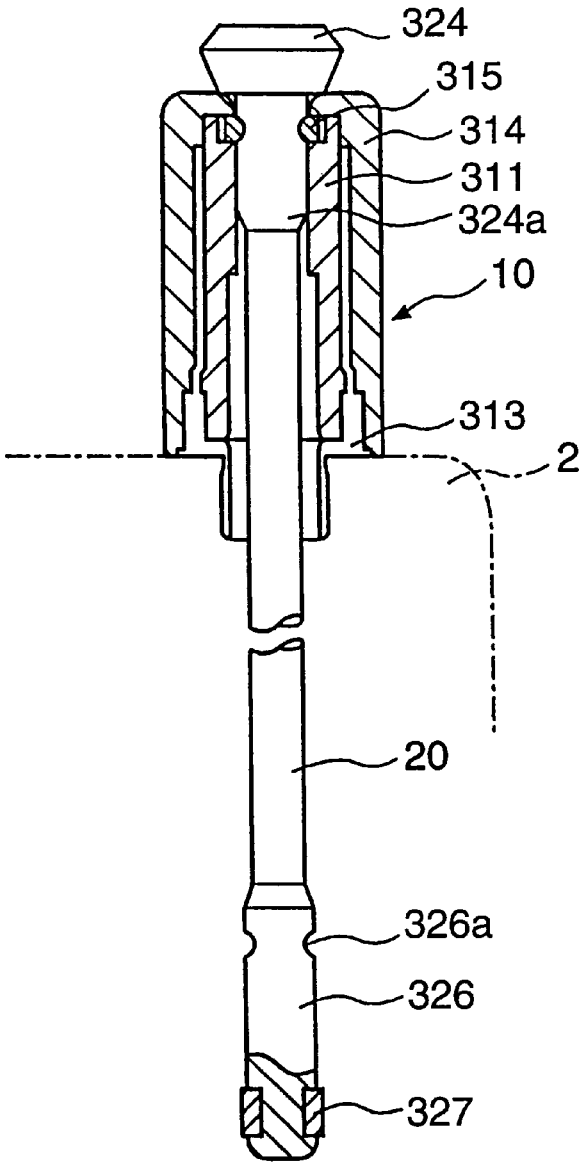
FIGS. 18*a* and 18*b* show the same antenna shown in FIGS. 17*a* and 17*b,* in which the second antenna portion is retracted into the casing.

FIG. 17*a* is a partly cross-sectional view showing the antenna in which the rod shaped antenna portion 20 is extended, and FIG. 17*b* is an enlarged partly cross-sectional view showing only the click structure. Further, FIG. 18*a* is a partly cross-sectional view showing the antenna in which the rod shaped antenna portion 20 is retracted, and FIG. 17*b* is an enlarged partly cross-sectional view showing only the click structure.

Figure 17C:
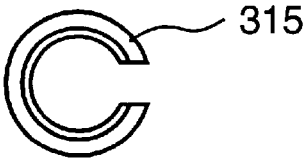
FIGS. 17*c* and 17*d* show the ring spring and the stopper both used for the coupling method shown in FIGS. 17*a* and 17*b,* respectively.

In the drawings, the first antenna portion 10 is formed by winding a sheet-shaped antenna element on an outer circumferential surface of a cylindrical core 11 formed of polyacetal. Further, the antenna element is formed in such a way that the electrical length thereof is about ¼ wavelength of the frequency band required to be transmitted and received. A metal fixture 313 for fixing the antenna to a casing 2 is provided at the lower end portion of the cylindrical core 311. A ring spring 315 as shown in FIG. 17*c* is attached to the upper end portion of the cylindrical core 311 coaxially with the core 311 and further held by a cap 314 from above. The cap 314 not only holds the ring spring 315 but also protects the antenna element disposed on the inner surface of the core 311. Further, the cap 314 is fixed to the metal fixture 313 at the end portion thereof. As shown in FIGS. 17*b* and 18*b*, the cylindrical core 311 is formed with a small-diameter sliding portion 311*a* and a large-diameter through portion 311*b* in an inner surface thereof. The sliding portion 311*a* of the core 311 is slidably fitted to a large-diameter portion (i.e., a top portion 324*a*) of the top 324 when the antenna is retracted (as shown in FIG. 18*b*) but to a joint portion 326 of the second antenna portion 20 when the antenna is extended as shown (in FIG. 17*b*). Further, this sliding portion 311*a* of the core 311 stops a stopper 327 as shown in FIG. 17*d* attached to the lower end of the joint portion 326.

Further, the inner diameter of the through portion 311*b* of the core 311 is large enough to freely pass the stopper 327 therethrough. However, when the core antenna element is not formed in contact with the core 311, or when the core antenna element can be formed within the axial length of the sliding portion 311*a* (even if formed), the through portion 311*b* can be omitted. In this structure, the stopper 327 is brought into contact with the end of the sliding portion 311*a* or the core 311.

As shown in FIGS. 17*b* and 18*b*, in the click structure of the second antenna portion 20 to the core 311, the ring spring 315 is engaged with a notch (recessed) portion 326*a* formed at the large-diameter joint portion 326 of the second antenna portion 20. In more detail, as shown in FIG. 17*c*, the ring spring 315 is formed with an axially split portion and formed of a resin (e.g., polyacetal), which is held coaxially with the core 311. The inner diameter of the ring spring 315 is slightly smaller than the outer diameter of the joint portion 326 and the top portion 324*a*, but larger than the outer diameter of the second antenna portion 20 (except the large-diameter portion). However, since the ring spring 315 is provided with spring characteristics, when the large diameter portion of the joint portion 326 is pushed into the core 11, the ring spring 315 can be slid along the outer surface of the joint portion 326. Therefore, when the second antenna portion 20 is extended, the large-diameter joint portion 326 is slide along the sliding portion 311*a* of the core 311 to such an extent that the notch portion 326*a* of the joint portion 326 reaches the ring spring 315. Here, since the diameter of the ring spring 315 is reduced and thereby fitted to the notch portion 326*a*, the ring spring 315 is fitted to the notch portion 326*a*, so that the second antenna portion 20 can be clicked (fixed) to the core 311. After that, since the intermediate portion of the second antenna portion 20 is smaller in diameter than the large diameter joint portion 326, the second antenna portion 20 can be passed through the ring spring 315, so that the second antenna portion 20 can be extended and retracted lightly without any frictional feeling.

Figure 17D:
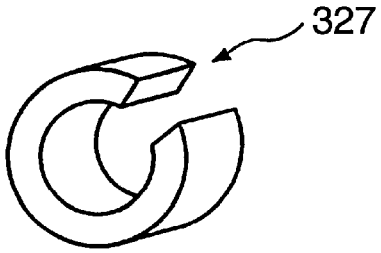
Figure 18B:
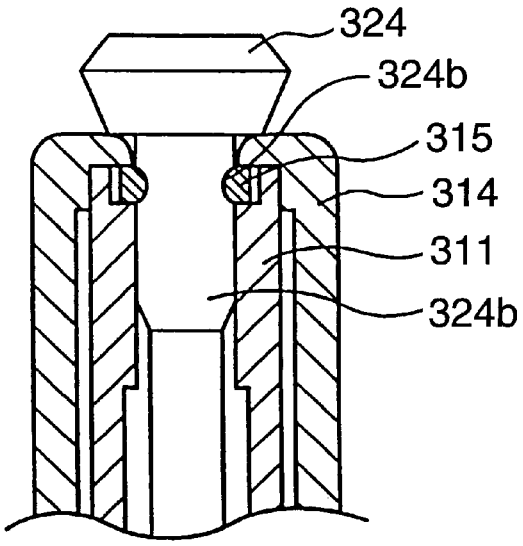

To the lower end portion of the joint portion 326, the stopper 327 as shown in FIG. 17*d* is fixed. Therefore, when the second antenna portion 20 is pulled upward excessively, since the sliding portion 311*a* of the core 311 cannot moved, the second antenna portion 20 is prevented from being extended out of the casing. The stopper 327 is also formed with an axially split portion and formed with a resin (e.g., polyacetal) as shown in FIG. 17*d*. Further, as depicted in FIG. 18*a*, the stopper 327 is attached to the joint portion 326 in such a way as to be engaged with a recessed portion formed in the inner end of the joint portion 326. Here, when the second antenna portion 20 is required to be inserted into the core 311 on condition that the stopper 327 has been attached to the second antenna portion 20, it is impossible to insert the second antenna portion 20 as far as the core 311 is not formed with a slit. When the core 311 is formed with a slit, the fitting condition between the antenna portion 20 and the core 311 is not stable. To overcome this problem, in the present embodiment, since the stopper 327 can be attached to the second antenna portion 20 easily after the second antenna portion 20 has been inserted into the core 311, it is possible to mount the second antenna portion 20 securely to the core 11 without removal thereof. That is, owing to the structure of the stopper 327 as described above, since the stopper 327 can be attached to the second antenna portion 20 after having been the second antenna portion 20 has been inserted into the core 311, it is possible to obtain a high reliable sliding structure without forming any split portion in the core 311.

When the second antenna portion 20 is inserted into the casing being pushed down, as shown in FIGS. 18*a* and 18*b*, the second antenna portion 20 other than the large diameter portion 324*a* can be dropped lightly. However, when the large diameter top portion 324*a* reaches the ring spring 315, since the inner diameter of the ring spring 315 is smaller than the outer diameter of the top portion 324*a*, the second antenna portion 20 is stopped from dropping. However, when the second antenna portion 20 is pushed further downward by a force, since the ring spring 315 is broaden outward in the radial direction thereof, the large diameter top portion 324*a* can be further pushed down being slid along the ring spring 315 and the sliding portion 311*a* of the core 311. When the notch (recessed) portion 324*b* formed in the top portion 324*a* reaches the ring spring 315, since the ring spring 315 is fitted to the notch 324*b*, the second antenna portion 20 can be clicked to the core 311. As a result, as shown in FIG. 18*b*, the second antenna portion 20 can be fixed to the core 311 with only the top 324 exposed on the top 314. Under these conditions, since the second antenna portion 20 is housed in the casing 2 and does not function as an antenna, only the first antenna portion 10 is kept exposed from the casing 2 so as to function as an antenna for receiving only a call signal.

As the second antenna portion 20, a coiled antenna having an electrical length of about ½ wavelength of the used frequency band or a series resonance circuit of a closed loop composed of an inductor element and a capacitor element can be used by protecting them with a resin. Further, when used for two frequency bands, two antenna elements are coupled via a trap or a phase shifter, as already explained.

In the above-mentioned embodiment, the first antenna element is formed on the outer circumferential surface of the core. However, when a part of the antenna is not always used, and therefore the antenna is extended only in use, it is unnecessary to dispose the first antenna element on the outer circumferential surface of the core.

As described above, in the antenna according to the present invention, since the structure is such that the extended and retracted antenna portion is formed with the large diameter sliding portion having a notch (recessed) portion engaged with a separate spring member, it is possible to obtain a stable sliding portion at all times without forming any split portion in the sliding portion. Further, since the spring member is constructed by a single ring spring, a strong spring characteristics can be obtained. As a result, a stable click operation can be maintained for many hours, whenever the antenna is extended and retracted from and into the casing in addition to its simple extension and retraction operation.

Further, since the first antenna portion can be formed simply by winding an antenna element around the outer circumferential surface of the core having the sliding portion, it is possible to construct the first antenna portion coupled with the second antenna portion simply by use of a lesser number of parts. As a result, it is possible to obtain an antenna suitable for use with a portable telephone set at a relatively low cost, in which the first antenna portion for receiving only a call signal and the second antenna portion extended to increase the sensitivity during communications can be coupled electrically.

FIFTH EMBODIMENT

Fifth embodiment of the antenna having the first and second antenna portions will be described hereinbelow with reference to the attached drawings, in which the first antenna element is formed integral with the metal fixture by a single die casting.

Figure 19:
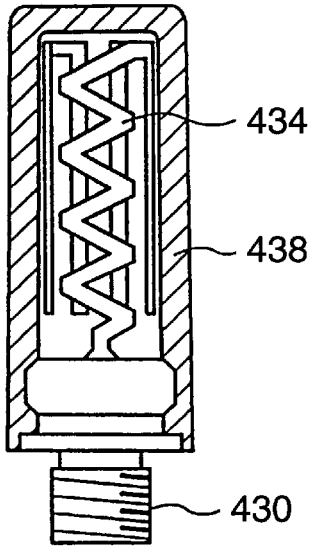
FIG. 19 is a partly cross-sectional view showing a fifth embodiment of the antenna according to the present invention, in which the antenna element and the metal fixture are formed integral with each other by die casting.
Figure 20A:
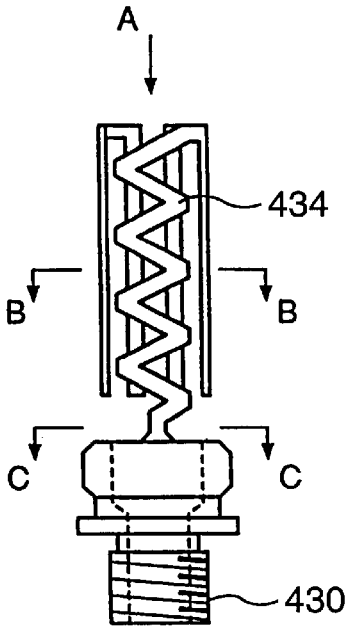
FIG. 20*a* is a cross-sectional view showing the same antenna shown in FIG. 19.
Figure 20B:
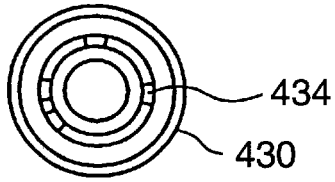
FIG. 20*b* is a front view showing the same antenna.
Figure 20C:
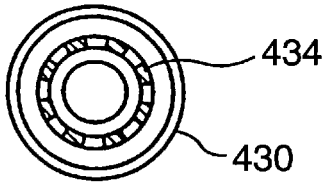
FIGS. 20*c* and 20*d* are cross-sectional view taken along the lines B—B and C—C in FIG. 20*a,* respectively.
Figure 20D:
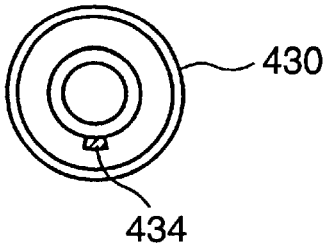

FIG. 19 is a cross-sectional view showing an antenna element (the first antenna portion), and FIG. 20 is a front view showing an antenna element formed together with the metal fixture. Further, FIGS. 20*b*, 20*c*, and 20*d* are cross-sectional views taken along the lines B—B, C—C and D—D in FIG. 20, respectively.

In FIGS. 19 and 20, the shapes of an antenna element (e.g., the first antenna portion) 434 and a metal fixture 430 are the same as already explained. In this embodiment, however, both the antenna element 434 and the metal fixture 430 are formed integral with each other of a zinc alloy, an aluminum alloy, or a magnesium alloy by die casting. Further, a cover 438 is fixed to the metal fixture 430 to protect the antenna element 434.

In the construction as described above, since the antenna element 434 is formed integral with the metal casting 430 by die casting, the antenna element 434 can be formed with an appropriate strength and rigidity, independently from the metal fixture 430. Therefore, it is possible to eliminate the core and any soldering work. Further, since the number of parts can be reduced and further soldering work can be eliminated, this embodiment is suitable for mass production. In addition, since the rigidity of the antenna element 434 is relatively large relative to the metal fixture 430, as compared with the other embodiments, the antenna element is not easily deformed by an external force or vibrations. Further, in comparison with the antenna element formed by winding a wire or plate by manual work, it is possible to eliminate the dispersion of the antenna dimensions and thereby to obtain stable antenna characteristics.

Figure 21A:
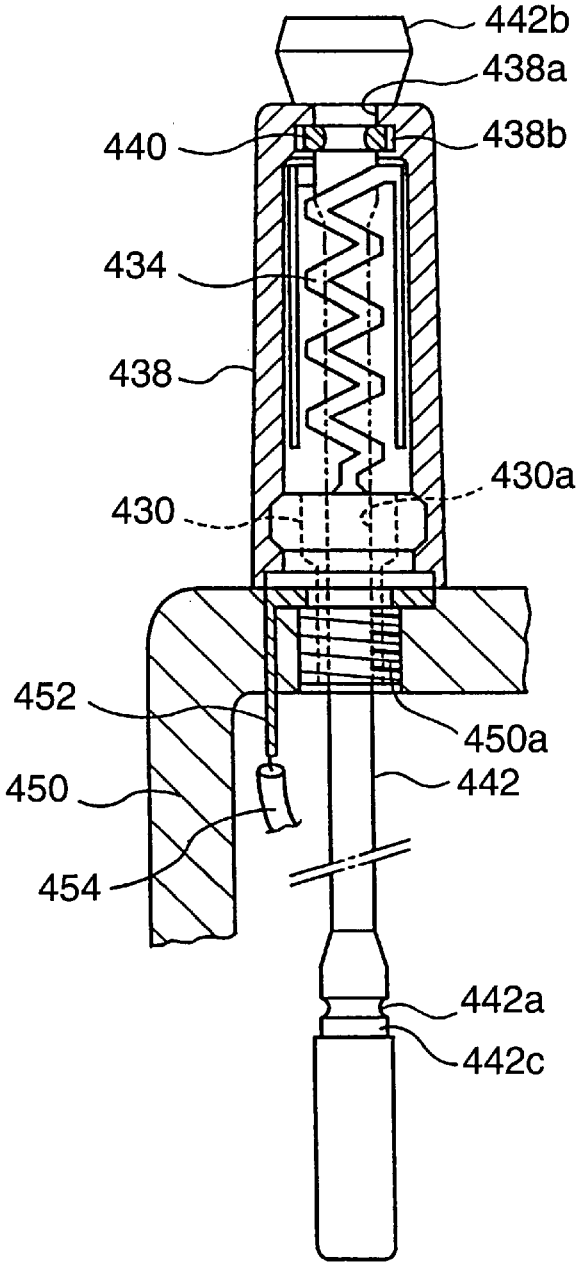
Figure 21B:
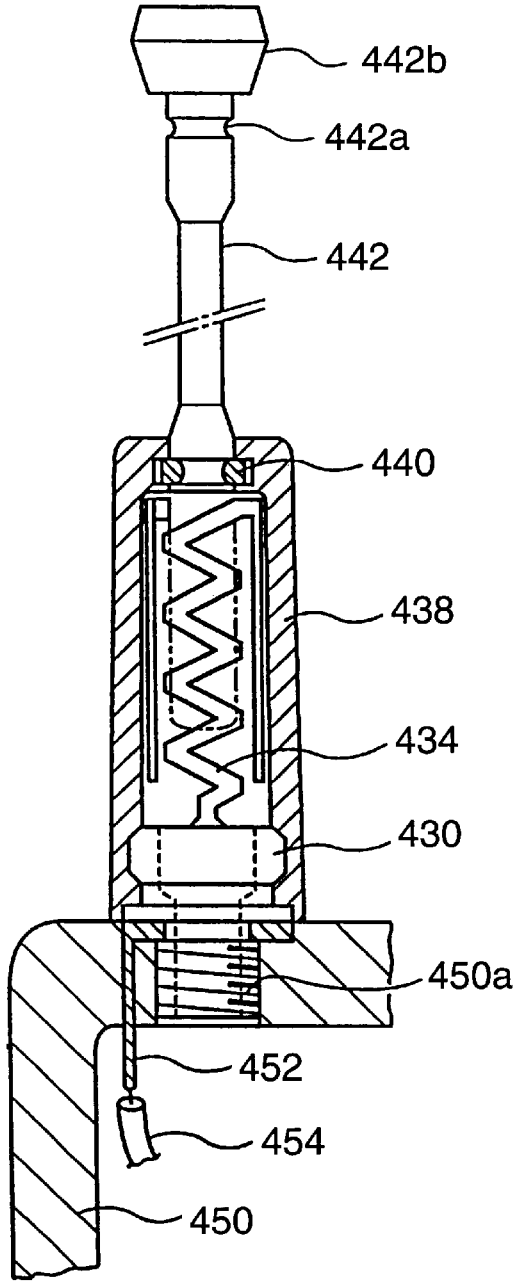

FIGS. 21*a* and 21*b* show a modification of the fifth embodiment, in which the die-casted antenna having both the antenna element 434 and the metal fixture 430 is coupled with an extendable and retractable rod antenna 442. FIG. 21*a* shows the state where the rod antenna is retracted and FIG. 21*b* shows the state where the rod antenna is extended, in which the same reference numerals have been retained for similar parts having the same functions as with the case shown in FIGS. 19 and 20.

In FIGS. 21*a* and 21*b*, the metal fixture 430 is formed with a through hole 430*a* extending in the axial direction that the rod antenna 434 is attached to a casing 450. Further, the antenna element 434 is formed integral with the metal fixture 430 in such a way as to extend from a position located on the radially outward side from the inner circumferential surface of the through hole 430*a*. Further, the cover 438 is formed with a through hole 438*a* coaxially with the through hole 430*a*. The through hole 438*a* is formed with a coaxial groove 438*b* in the inner circumferential surface thereof, and an elastic stop ring 440 having an inner diameter smaller than the inner diameter of the through hole 438*a* is attached to this groove 438*b*. This stop ring 440 is not necessarily an annular shape but an elastic ring formed with an axially split portion at one end thereof. Further, the axially extendable and retractable rod antenna element 442 is fitted to the through hole 438*a* of the cover 438 and the through hole 430*a* of the metal fixture 430. This rod antenna element 442 is formed with two slightly large-diameter portions on both sides thereof as compared with that of the intermediate portion thereof and with two engage grooves 442*a* engaged with the stop ring 440 on both sides thereof. Further, a knob 442*b* is attached to the uppermost end of the rod antenna element 442 to restrict the axial movement of the antenna element 442 when retracted into the casing 450. Further, the rod antenna element 442 is formed with a shoulder portion 442*c* at the lowermost end thereof to stop the axial movement of the rod antenna element 442 when extended from the casing 450.

The antenna having both the antenna element 434 and the rod antenna element 442 can be fixed to the casing 450 by screwing the male threaded portion of the metal fixture 430 with the female threaded portion of the mounting hole 450*a* of the casing 450. When screwed, a feeder metal 452 can be connected to the metal fixture 430 electrically. This feeder metal 452 is connected to a radio circuit (not shown) via a coaxial cable 454.

In the construction as described above, when the stop ring 440 is engaged with he engage groove 442*a* formed on both sides of the rod antenna element 442, the rod antenna element 442 can be held at the two extended and retracted positions, respectively. When extended, since the base end portion of the rod antenna element 442 is coupled to the antenna element 434 capacitively at high frequency, it is possible to use the antenna element 434 and the rod antenna element 442 as a single antenna.

Therefore, the rod antenna 442 is extended for use as a high gain antenna during speech by a portable telephone set, and retracted for use as a standby antenna for receiving an incoming call signal by use of only the antenna element 434, so that it is possible to obtain an antenna excellent in portability and sensitivity.

Further, in the above-mentioned embodiments, although the antenna element 434 is returned into a zigzag shape, without being limited only thereto, the antenna element can be formed into a helical shape. Further, although the rod antenna element 442 is a single rod, without being limited only thereto, a telescopic rod antenna element can be used.

SIXTH EMBODIMENT

Figure 22:
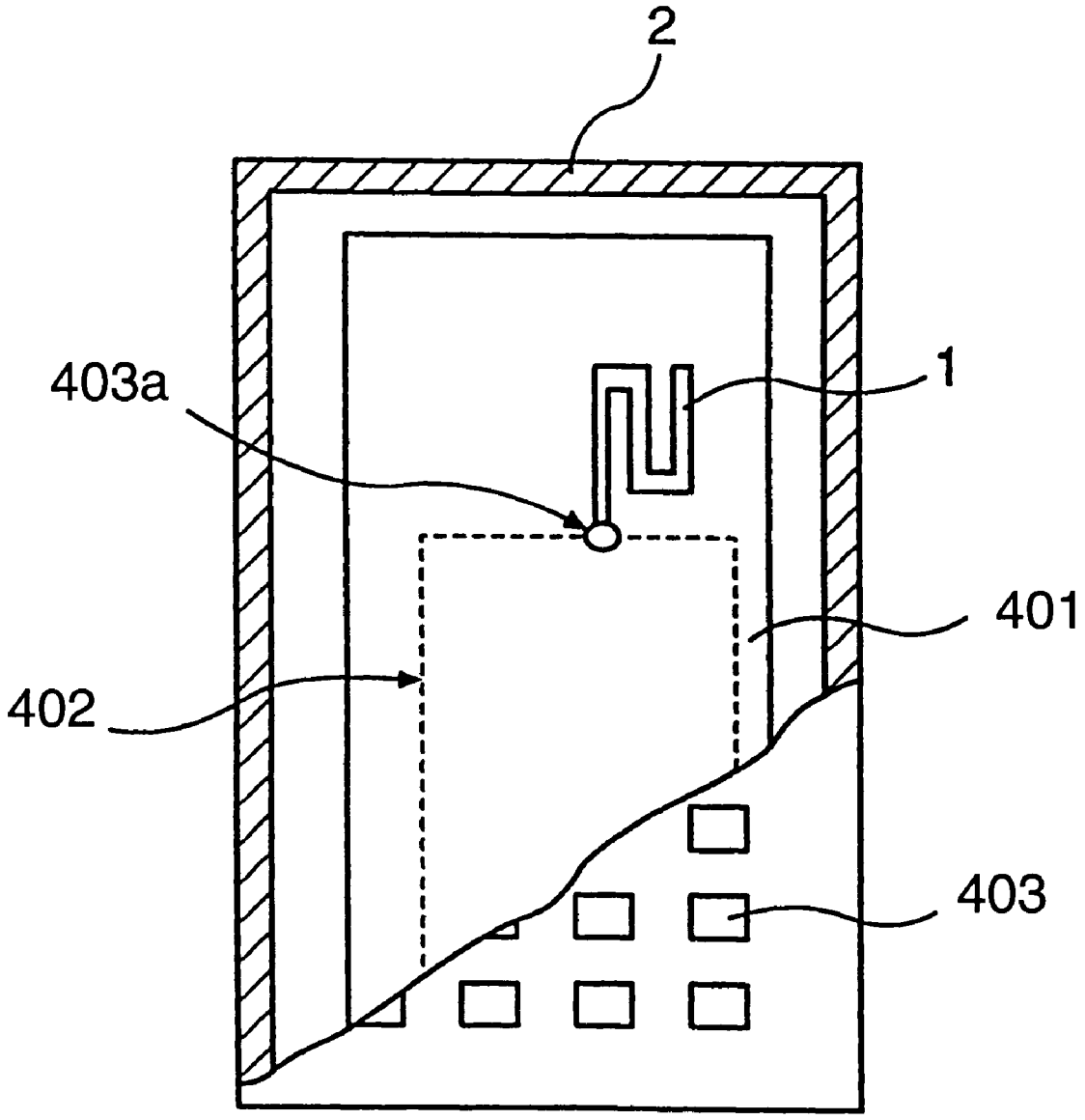
FIG. 22 is a partly cross-sectional view showing a sixth embodiment of the antenna according to the present invention, in which the antenna (as shown in FIG. 1) is formed on a circuit board housed in a radio apparatus.

Further, FIG. 22 shows a sixth embodiment where the antenna element 1 as shown in FIG. 1 is formed on a high frequency circuit board 401. This embodiment is particularly suitable for a portable telephone set in the radio apparatus. As shown in FIG. 22, the antenna element 1 is connected to a high frequency circuit 402 via a feeder point 403*a*. Further, a push button type ten keys 403 are arranged on the surface of the casing 2.

Figure 23:
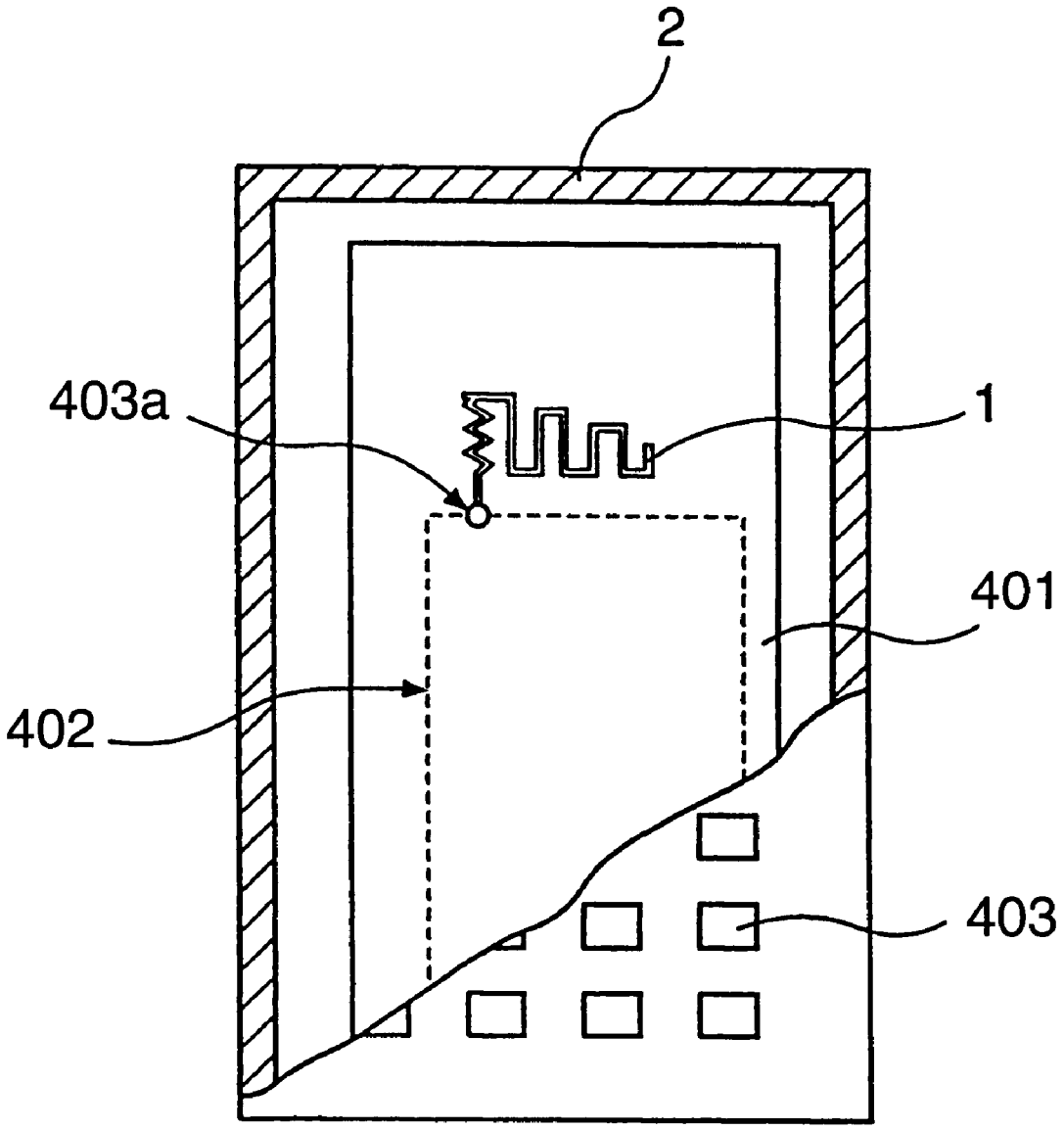
FIG. 23 is a partly cross-sectional view showing the same sixth embodiment of the antenna according to the present invention, in which the antenna (as shown in FIG. 15) is formed on a circuit board housed in a radio apparatus.
Figure 24:
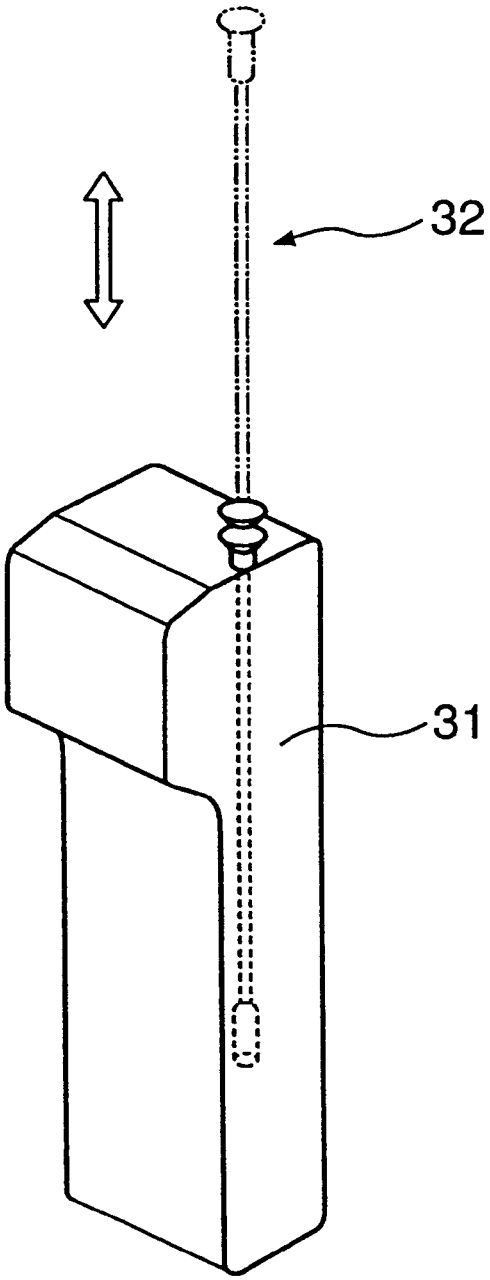
FIG.24 PRIOR ART
FIG. 24 is a perspective view showing an example of the prior art antenna attached to a radio apparatus.

Further, FIG. 23 shows a similar embodiment where the antenna element 1 as shown in FIG. 15 is formed on a high frequency circuit board 401. This embodiment is particularly suitable for a portable telephone set in the radio apparatus. As shown in FIG. 23, the antenna element 1 is connected to a high frequency circuit 402 via a feeder point 403*a*. Further, a push button type ten keys 403 are arranged on the surface of the casing 2.

In the above-mentioned embodiments, the high frequency circuit board is usually formed of epoxy resin, and the high frequency circuit is formed by a pattern print. Further, when a ceramic substrate is used, the circuit pattern is formed by baking a copper foil thereon.

As described above, when the antenna element is formed within the casing, since the antenna element does not project toward the outside, the radio apparatus is convenient when carried. Further, since the antenna element can be manufactured simultaneously together with the high frequency circuit by printing process, it is possible to reduce the cost thereof, as compared with the case where the antenna element is attached to the casing from the outside.

What is claimed is:

1. An antenna, wherein an antenna element formed by a long conductor is formed with at least one returned portion arranged substantially in parallel to a longitudinal direction of the antenna element, wherein the long conductor and the returned portion are adjacent to one another and where a physical length of the antenna element in the longitudinal direction is determined to such a length so as to be substantially resonated in a first frequency band, and the at least one returned portion is formed so as to enable the antenna to transmit and receive signals of said first frequency band and a second frequency band, wherein the second frequency band is approximately an even number times higher than the first frequency band.

2. The antenna of claim 1, wherein the long conductor is formed by a belt-shaped body.

3. The antenna of claim 1, wherein the long conductor and the returned portion are adjacent to one another and where the antenna element formed with the returned portion is wound into a coil shape with the longitudinal direction of the antenna element as a central axis thereof so as to maintain electrical coupling with the adjacent antenna element.

4. The antenna of claim 1, wherein the long conductor is formed into a zigzag shape and formed with the returned portion in such a way that zigzag portions thereof are adjacent to each other.

5. The antenna of claim 1, wherein the length of the long conductor in the longitudinal direction is formed so as to correspond to substantially ¼ wavelength of the first frequency band.

6. The antenna attached to a radio apparatus, comprising:

a first antenna portion having one end connected to a feeder portion and defined by claim 1; and a second antenna portion separated from the feeder portion when housed in a casing of the radio apparatus, and having one end coupled electrically to the other end of the first antenna portion when extended externally from the casing of the radio apparatus.

7. The antenna of claim 6, wherein the other end of the first antenna portion and one end of the second antenna portion are electrically coupled capacitively and/or inductively, without direct contact between the two antenna portions.

8. The antenna, comprising:

a first antenna portion having a metal fixture connected to a feeder portion at a lower end portion thereof and defined as claim 1; and a second antenna portion separated from the feeder portion when housed in a casing of a radio apparatus and having a stopper portion disposed at a lower end thereof and connected to the feeder portion when extended externally from the casing of the radio apparatus, the metal fixture of the first antenna portion being fixed to an upper end portion of the extended second antenna portion.

9. The antenna of claim 8, wherein the first antenna portion and the second antenna portion are connected to each other electrically.

10. The antenna of claim 8, wherein the first antenna portion and the second antenna portion are coupled to each other capacitively and/or inductively.

11. The antenna of claim 8, wherein the second antenna portion is constructed by the antenna as defined by claim 1.

12. The radio apparatus, comprising:

a transmit and receive circuit;

a casing for covering the transmit and receive circuit;

a feeder portion disposed in the vicinity of the casing and electrically connected to the transmit and receive circuit; and an antenna attached to the casing and electrically connected to the feeder portion, the antenna as defined by claim 2 being used as at least a part of the antenna of the radio apparatus.

13. The antenna of claim 2, wherein the first frequency band includes the frequency 900 MHz and the second frequency band includes the frequency 1800 MHz.

14. An antenna, comprising:

a first antenna portion having an antenna element formed by a long conductor and formed with at least one returned portion arranged substantially in parallel to a longitudinal direction of the antenna element, the first antenna portion being formed in such a way that a total electrical length thereof is substantially ¼ wavelength of a first frequency band but substantially ¾ wavelength of a second frequency band; and a second antenna portion having one end portion connected electrically to the first antenna portion when extended externally from a casing, the second antenna portion being composed of a first antenna element formed in such a way that an electrical length thereof is substantially ½ wavelength of the second frequency band and a second antenna element connected to the first antenna element electrically and formed in such a way that a total electrical length together with the first antenna element is substantially ½ wavelength of the first frequency band.

15. The antenna of claim 14, wherein the first antenna element and the second antenna element are connected to each other via a trap parallel-resonated in the second frequency band.

16. The antenna of claim 14, wherein the first antenna element and the second antenna element are connected to each other via a phase shifter for shifting a phase of 180 degrees with respect to the second frequency band.

17. The antenna of claim 14, wherein the first antenna portion is formed with a coupling returned portion at a position an electrical length of substantially ¼ wavelength of the second frequency band away from one end portion thereof on feeder portion side, and further the second antenna portion is so disposed as to be coupled capacitively and/or inductively with both the coupling returned portion and the other end of the first antenna portion.

18. An antenna, wherein a second antenna portion formed so as to have an electrical length of substantially ½ wavelength of one frequency band is connected electrically, when extended, to a first antenna portion formed in such a way a total length thereof has an electrical length of substantially ¾ wavelength of the one frequency band; and, the first antenna portion is formed in such a way that a portion corresponding to an electrical length of substantially ½ wavelength of the frequency band functions as a phase shifter for canceling electric fields with each other.

19. An antenna, comprising:

a first antenna portion having an antenna element formed by a long conductor and formed with at least one returned portion arranged substantially in parallel to a longitudinal direction of the antenna element; and a second antenna portion having one end portion connected electrically to the first antenna portion when extended externally from a casing, the second antenna portion being a series resonance circuit having an inductor element and a capacitor element and coupled with the first antenna portion capacitively and/or inductively.

20. The antenna of claim 19, wherein the first antenna portion is formed with the returned portion for transmitting and receiving both first and second frequency bands, respectively; the second antenna portion is composed of a first series resonance circuit series-resonated in the first frequency band and a second series resonance circuit series-resonated in the second frequency band; and the first and second series resonance circuits are coupled with each other capacitively and/or inductively.

21. An antenna, comprising:

an antenna element formed by a long conductor and formed with at least one returned portion arranged substantially in parallel to a longitudinal direction of the antenna element in such a way that an electrical length thereof is substantially ¾ wavelength of a frequency band of transmitted and received signals; and at least half of an electrical length of substantially ¼ wavelength of the frequency band beginning from an end portion of the antenna element on a side opposite to a feeder portion side is formed as an extended antenna piece extending substantially in non-parallel to the substantially parallel-formed antenna element.

22. The antenna of claim 21, wherein the at least half of the electrical length of substantially ¼ wavelength portion extending substantially in non-parallel is extended in such a way that small crank-shaped portions are repeatedly formed along the substantially parallel-formed antenna element.

23. An antenna, comprising:

an antenna element formed by a long conductor and formed with at least one returned portion arranged substantially in parallel to a longitudinal direction of the antenna element in such a way that an electrical length thereof is substantially ¼ wavelength of a first frequency band; and a coupling returned portion formed so as to be coupled with a second antenna portion capacitively and/or inductively at a position an electrical length of substantially ¼ wavelength of a second frequency band away from a feeder portion side of the antenna element.

24. The antenna, comprising:

a first antenna portion as defined by claim 23 and formed by an antenna element disposed on an outer circumferential portion of a cylindrical insulating body;

a second antenna portion coupled with the first antenna portion capacitively and/or inductively when extended externally being slidably moved along an inner circumferential portion of the insulating body; and the end portion of the antenna element of the first antenna portion being formed at a position farther away from the second antenna portion than the coupling returned portion in such a way that the second antenna portion can be easily coupled with the coupling returned portion of the first antenna portion in the second frequency band at an end portion opposite to a feeder portion of the antenna element of the first antenna portion.

25. An antenna, comprising:

a cylindrical core fixed to a metal fixture at one end thereof;

a ring spring disposed coaxially with the core on the other end portion of the core;

a cap formed with a through hole communicating with a central hole of the core and covering the core and the ring spring; and a rod antenna member formed with a large-diameter top portion and a joint portion on both ends thereof so as to be slidably fitted to the central hole of the core, wherein a notch engaged with the ring spring is formed at the top portion and the joint portion of the rod antenna member, respectively.

26. The antenna of claim 25, wherein a split-type stopper having an outer diameter larger an inner diameter of a hole of the cylindrical core, through which the joint portion of the rod antenna member is slidably moved, is fitted to an end portion of the joint portion of the rod antenna member.

27. The antenna of claim 25, wherein the cylindrical core is formed of an electrically insulating substance, and a first antenna portion is formed by disposing an antenna element on an outer circumference of the core.

28. A radio apparatus, comprising:

a high frequency circuit board disposed in a casing; and, an antenna formed with an antenna element formed by a long conductor and formed with at least one returned portion arranged substantially in parallel to a longitudinal direction of the antenna element, the antenna being provided on the high frequency circuit board, wherein the long conductor and the returned portion are adjacent to one another and where a physical length of the antenna element in the longitudinal direction is determined to such a length so as to be substantially resonated in a first frequency band, and the at least one returned portion is formed so as to enable the antenna to transmit and receive signals of said first frequency band and a second frequency band, wherein the second frequency band is approximately an even number times higher than the first frequency band.

29. A radio apparatus, comprising:

a high frequency circuit board disposed in a casing; and an antenna element formed by a long conductor and formed with at least one returned portion arranged substantially in parallel to a longitudinal direction of the antenna element in such a way that an electrical length thereof is substantially ¾ wavelength of a frequency band of transmitted and received signals; and at least half of an electrical length of substantially ¼ wavelength of the frequency band beginning from an end portion of the antenna element on a side opposite to a feeder portion side is formed as an extended antenna piece extending substantially in non-parallel to the substantially parallel-formed antenna element, the antenna being provided on the high frequency circuit board.

30. An antenna attached to a radio apparatus comprising:

a first antenna portion wherein an antenna element formed by a long conductor is formed with at least one returned portion arranged substantially in parallel to a longitudinal direction of the antenna element, one end of said first antenna portion connected to a feeder portion; and, a second antenna portion separated from the feeder portion when housed in a casing of the radio apparatus, and having one end coupled electrically to the other end of the first antenna portion when extended externally from the casing of the radio apparatus, wherein the antenna element is formed by an electrically conductive belt-shaped body disposed on an outer circumference of a cylindrical bobbin formed of an electrically insulating substance.

31. The antenna of claim 30, wherein one end of the first antenna element is electrically connected to a metal fixture for mounting a feeder disposed at a lower portion of the first antenna portion; and the other end of the first antenna element is formed with a projection portion projecting radially inward of the bobbin via a through hole formed at a part of a side wall of the bobbin; and the first and second antenna portions are connected electrically by fitting the projection portion to a recessed portion formed in a metal stopper attached to a lower end of the second antenna portion in electrical contact with the second antenna element.

* * * * *